US012650243B2

(12) United States Patent
Park et al.

(10) Patent No.: US 12,650,243 B2
(45) Date of Patent: Jun. 9, 2026

(54) AIR HEATING APPARATUS

(71) Applicant: KYUNGDONG NAVIEN CO., LTD., Pyeongtaek-si (KR)

(72) Inventors: Jun Kyu Park, Seoul (KR); Jae Sung Hong, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 404 days.

(21) Appl. No.: 18/202,183

(22) Filed: May 25, 2023

(65) Prior Publication Data

US 2024/0060680 A1 Feb. 22, 2024

(30) Foreign Application Priority Data

Aug. 17, 2022 (KR) ..... 10-2022-0102749
Aug. 17, 2022 (KR) ..... 10-2022-0102750
(Continued)

(51) Int. Cl.
*F24H 9/00* (2022.01)
*F24H 3/02* (2022.01)
(Continued)

(52) U.S. Cl.
CPC ..... *F24H 6/00* (2013.01); *F24H 3/02* (2013.01); *F24H 9/0005* (2013.01);
(Continued)

(58) Field of Classification Search
CPC . F24H 8/00; F24H 3/0488; F24H 3/08; F24H 3/085; F24H 3/087; F24H 3/105;
(Continued)

(56) References Cited

U.S. PATENT DOCUMENTS 3,111,939 A * 11/1963 Peoples ..... F24H 3/087 126/104 A
3,308,805 A 3/1967 Stockli
(Continued)

FOREIGN PATENT DOCUMENTS

EP 2224189 A 9/2010
GB 2400637 A 10/2004
(Continued)

OTHER PUBLICATIONS

NTI, GF 200 Installation Manual. Year: 2018.
(Continued)

*Primary Examiner* — Steven S Anderson, II
(74) *Attorney, Agent, or Firm* — ALG Intellectual Property, LLC

(57) ABSTRACT

Disclosed is an air heating apparatus including an expansion tank which preserves water, a water heater which receives heat from a combustion gas generated through a combustion reaction and heats the water, a heating heat exchanger which receives the water heated by the water heater and exchanges heat with air that is to be discharged for heating, a fan which sends the air to the heating heat exchanger, and a case, in which the water heater, the expansion tank, the heating heat exchanger, and the fan are disposed in an interior thereof.

17 Claims, 22 Drawing Sheets

(30) Foreign Application Priority Data

Aug. 17, 2022 (KR) ..... 10-2022-0102751
Aug. 17, 2022 (KR) ..... 10-2022-0102752

(51) Int. Cl.
*F24H 6/00* (2022.01)
*F24H 9/02* (2006.01)
*F24H 9/12* (2022.01)

(52) U.S. Cl.
CPC ..... *F24H 9/0042* (2013.01); *F24H 9/02* (2013.01); *F24H 9/12* (2013.01)

(58) Field of Classification Search
CPC . F24H 3/1008; F24H 6/00; F24D 9/00; F24D 3/1083; F24D 19/1015; F24D 5/02; F24D 9/2085
See application file for complete search history.

(56) References Cited

U.S. PATENT DOCUMENTS 3,718,154 A 2/1973 Doumany
4,449,511 A 5/1984 Hays et al.
4,622,947 A * 11/1986 Hays ..... F24H 3/087 237/55
5,361,751 A 11/1994 Biggs
5,408,986 A 4/1995 Bigham
5,443,364 A 8/1995 Mistry et al.
6,021,775 A * 2/2000 Dempsey ..... F24H 3/105 126/91 A
6,612,267 B1 9/2003 West
6,886,756 B2 5/2005 Rolph et al.
7,036,498 B2 5/2006 Riepenhoff et al.
8,353,463 B2 1/2013 York et al.
9,212,820 B2 12/2015 Kowald et al.
10,288,314 B2 5/2019 Sarkis, Sr.
2009/0179079 A1 7/2009 Ruijven
2013/0075062 A1* 3/2013 Noman ..... F24F 13/081 165/96
2019/0212033 A1 7/2019 Consadori et al.
2022/0146147 A1 5/2022 White
2022/0178623 A1 6/2022 Park et al.
2022/0214049 A1 7/2022 Doepker
2024/0060680 A1 2/2024 Park et al.
2024/0060681 A1 2/2024 Park et al.
2024/0060682 A1 2/2024 Park et al.
2024/0060683 A1 2/2024 Park et al.

FOREIGN PATENT DOCUMENTS

JP 2005037019 A 2/2005
KR 20110086956 A 8/2011
KR 1020210054329 A 5/2021
KR 20220078470 A 6/2022
KR 1020220078515 A 6/2022

OTHER PUBLICATIONS

NTI, GF 200, Condensing Tankless & Furnace Combined. Year; 2018.
Office Action received in U.S. Appl. No. 18/202,198 on Jul. 22, 2025.
Office Action received in U.S. Appl. No. 18/202,204 on Aug. 15, 2025.
Office Action received in U.S. Appl. No. 18/202,191 on Jan. 9, 2026.
Office Action received in U.S. Appl. No. 18/202,198 on Dec. 9, 2025.

* cited by examiner

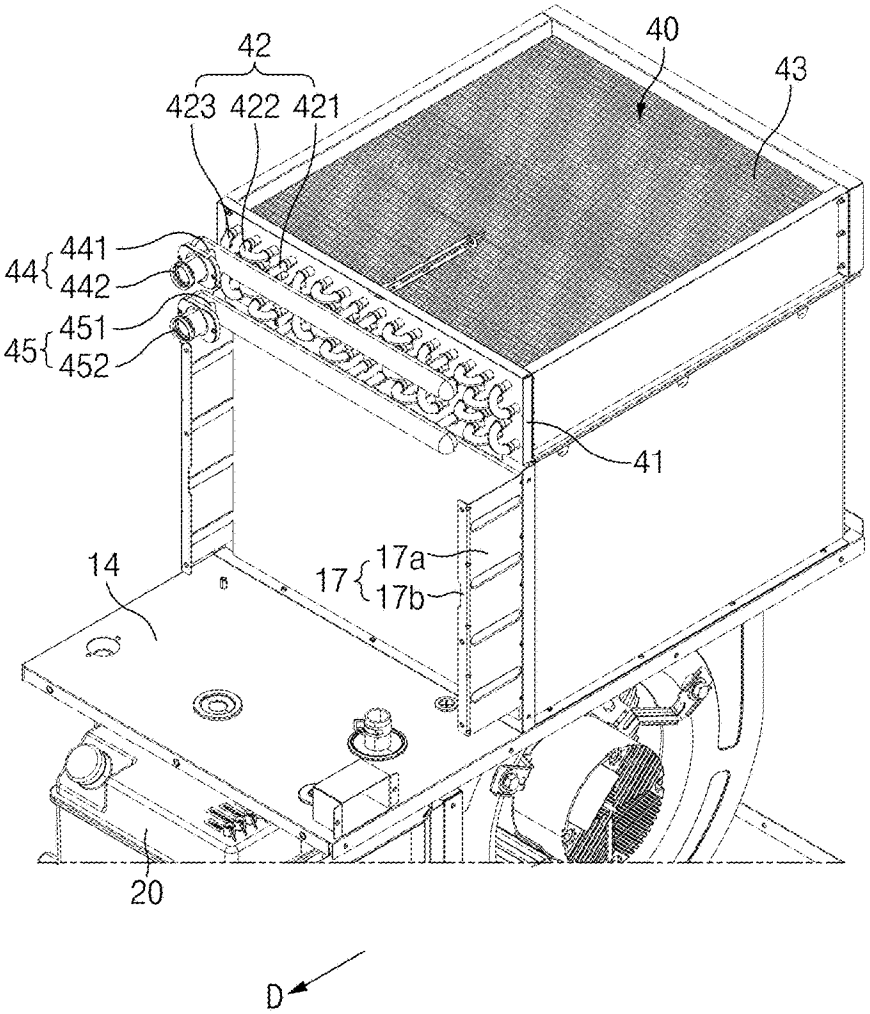
FIG.8
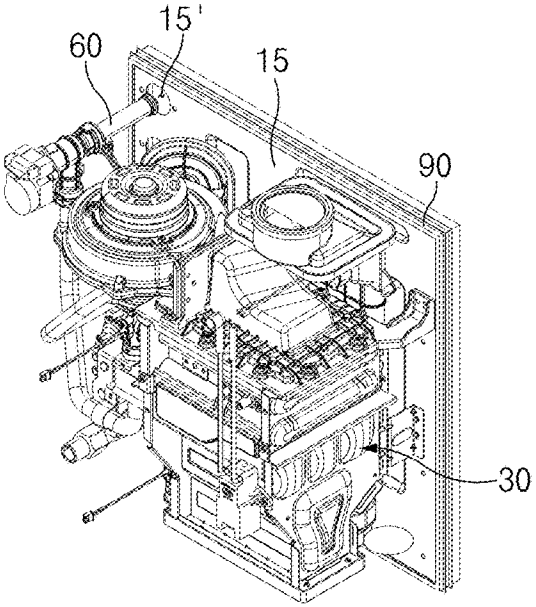

AIR HEATING APPARATUS

CROSS-REFERENCE TO RELATED APPLICATION

This application claims the benefit of priority to Korean Patent Application Nos. 10-2022-0102749, 10-2022-0102750, 10-2022-0102751, and 10-2022-0102752, filed in the Korean Intellectual Property Office on Aug. 17, 2022, the entire contents of which are incorporated herein by reference.

TECHNICAL FIELD

The present disclosure relates to an air heating apparatus.

BACKGROUND

In North American houses, heating may be performed through a scheme of supplying heated air by using ducts connected to rooms. For heating of the air, a device called a gas furnace is generally used. The heat may be supplied through a scheme of delivering heat generated by burning a fuel to the air in a gas furnace, and distributing the heated air to the rooms.

The gas furnace generally employs a scheme of causing a combustion gas of a high temperature generated through a combustion reaction of a burner to flow into an interior of a pipeline included in a heat exchanger and causing air to flow around the pipeline to heat the air through heat exchange of the air and the combustion gas in the heat exchanger.

The gas furnace may have a problem of leakage of the combustion gas or drying of the air in the house. To supplement the problem of the above-described furnace, application of a new form of a furnace called a hydro-furnace may be considered.

The hydro-furnace generally employs a scheme of heating water through a combustion gas of a high temperature generated through a combustion reaction of a burner, causing the heated water to flow into an interior of a pipeline of a heat exchanger, causing air to flow around the pipeline by using a fan, and heating the air through heat exchange of the water and the air.

However, the hydro-furnace has a form of a complex structure as a whole. Accordingly, the entire hydro-furnace has to be disassembled when an interior of the hydro-furnace, in particular, a part located inside breaks down, and thus a repair thereof is not easy.

Furthermore, the locations of the hydro-furnaces are different for the houses, and due to pipes that protrude to an outside of the hydro-furnace to introduce the water or the fuel into the interior of the hydro-furnace, there is a restriction in free disposition of the hydro-furnace.

Furthermore, when the water is supplemented in the expansion tank located in the interior of the hydro-furnace, the water has to be filled in the expansion tank in the interior thereof after a case of the hydro-furnace is separated first, and thus a process of filling the water is complex.

Furthermore, in the hydro-furnace, the number of parts that constitute the interior thereof is large, and an overall size thereof increases as the parts are combined.

SUMMARY

The present disclosure has been made to solve the above-mentioned problems occurring in the prior art while advantages achieved by the prior art are maintained intact.

An aspect of the present disclosure provides an air heating apparatus, internal parts of which may be easily repaired.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an air heating apparatus includes an expansion tank which preserves water, a water heater which receives heat from a combustion gas generated through a combustion reaction and heats the water, a heating heat exchanger which receives the water heated by the water heater and exchanges heat with air that is to be discharged for heating, a fan which sends the air to the heating heat exchanger, and a case, in which the water heater, the expansion tank, the heating heat exchanger, and the fan are disposed in an interior thereof, the case includes an outer box having a first opening in a reference direction that is one direction that is perpendicular to an upward/downward direction, a first opening cover coupled to the outer box and covering the first opening when being coupled to the outer box, a first partition wall coupled to the outer box, and extending along the reference direction to divide an interior of the outer box to a first division space and a second division space, a second partition wall disposed in the interior of the outer box to be perpendicular to the first partition wall to divide the first division space to a (1-1)-th division space and a (1-2)-th division space, and a third partition wall disposed in the interior of the outer box to be perpendicular to the first partition wall to divide the second division space to a (2-1)-th division space and a (2-2)-th division space, and the second partition wall and the third partition wall may be separated from the interior of the outer box.

BRIEF DESCRIPTION OF THE DRAWINGS

The above and other objects, features and advantages of the present disclosure will be more apparent from the following detailed description taken in conjunction with the accompanying drawings:

FIG. 8 is a view illustrating a state, in which a second partition wall is separated from an outer box;

DETAILED DESCRIPTION

Figure 1:
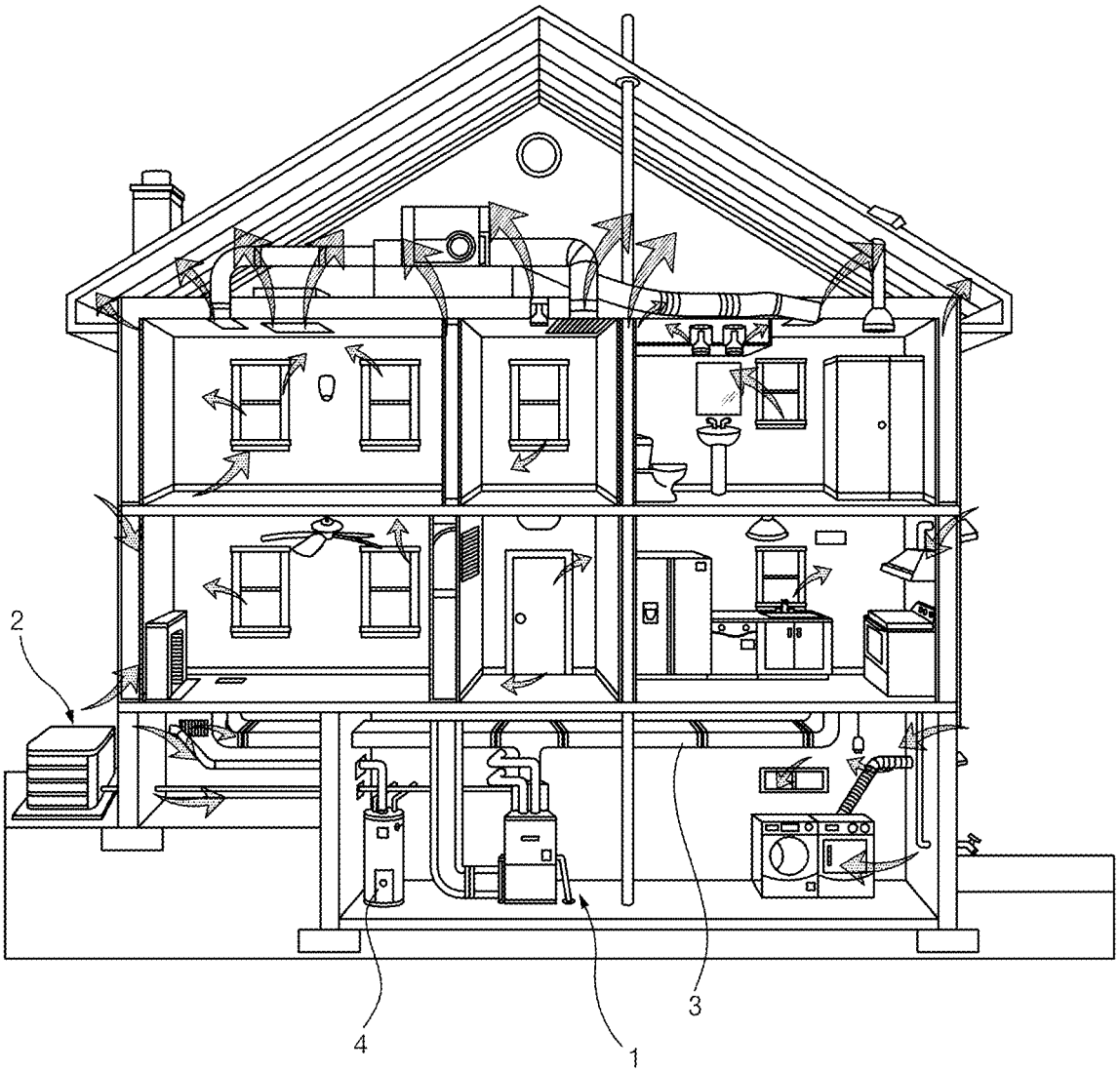
FIG. 1 is a view illustrating a heating system including an air heating apparatus according to a first embodiment of the present disclosure.

Hereinafter, some embodiments of the present disclosure will be described in detail through exemplary drawings. Throughout the specification, it is noted that the same or like reference numerals denote the same or like components even though they are provided in different drawings. Further, in the following description of the present disclosure, a detailed description of known functions and configurations incorporated herein will be omitted when it may make the subject matter of the present disclosure rather unclear.

FIG. 1 is a view illustrating a heating system including an air heating apparatus according to a first embodiment of the present disclosure.

Referring to the drawing, the heating system including the air heating apparatus according to the first embodiment of the present disclosure may be installed in a house. The heating system may include an air heating apparatus 1 for heating air. The air heating apparatus 1 may be connected to a duct 3 connected to rooms of a house, and may perform heating by delivering the heated air to the rooms. The air may be introduced into the air heating apparatus 1 from an outside of the house, and may return to the air heating apparatus 1 via the rooms of the house. The air may be introduced into the air heating apparatus 1 from the outside of the house, but in the specification of the present disclosure, a description will be made with an assumption that basically the air returns.

In the specification, a forward/rearward direction, a leftward/rightward direction, and an upward/downward direction are referred for convenience of description, and may be directions that are perpendicular to each other. However, the directions are determined relatively with respect to a direction, in which the air heating apparatus 1 is arranged, and the upward/downward direction does not always mean a vertical direction.

The heating system may further include a separate heater 4 for foiling hot water, and may be provided with a condenser 2 that causes cold air to be supplied through the air heating apparatus 1 by supplying a refrigerant to the air heating apparatus 1 in a summer season as an outdoor unit.

First Embodiment

Figure 2:
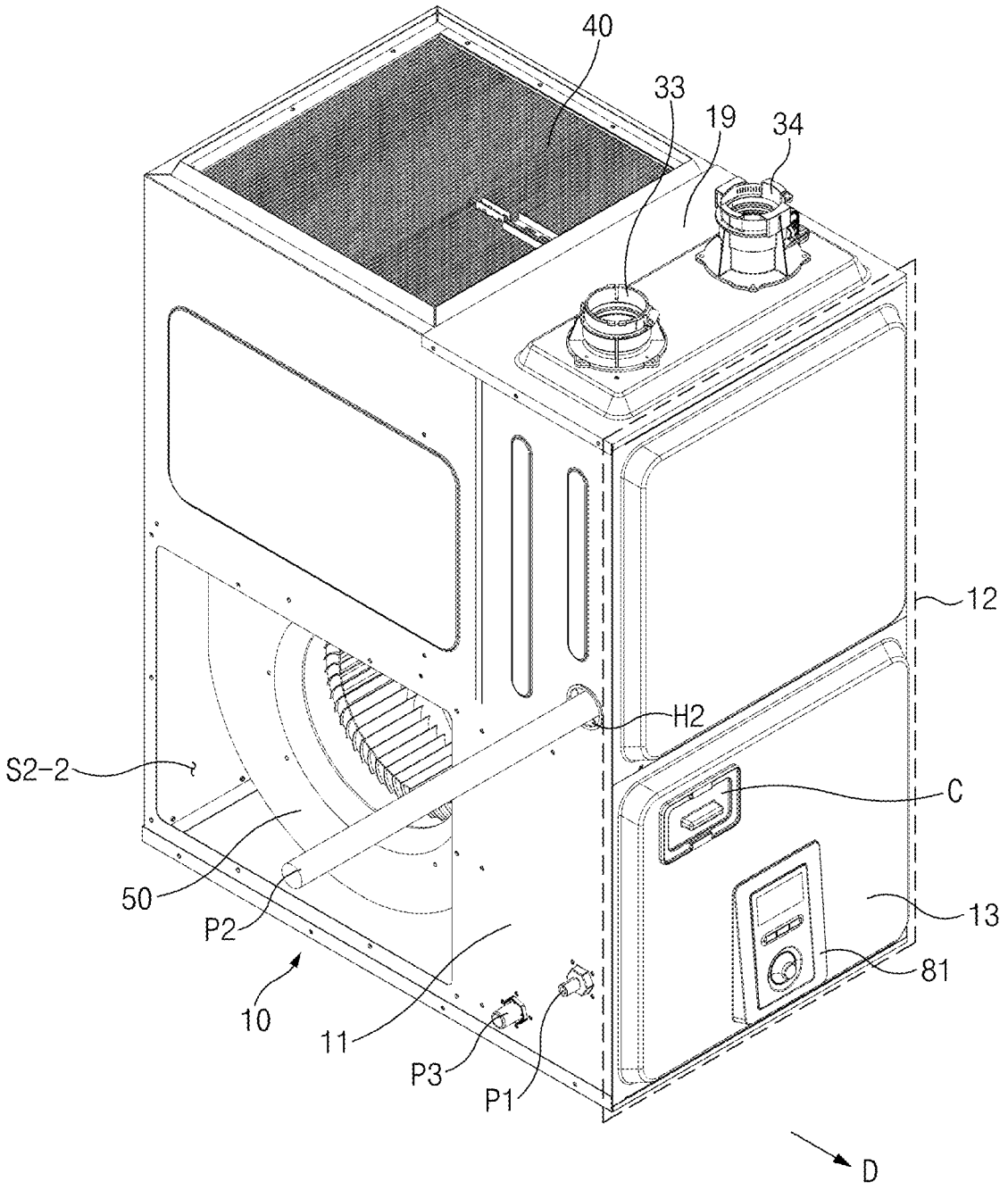
FIG. 2 is a perspective view illustrating an air heating apparatus according to a first embodiment of the present disclosure.
Figure 3:
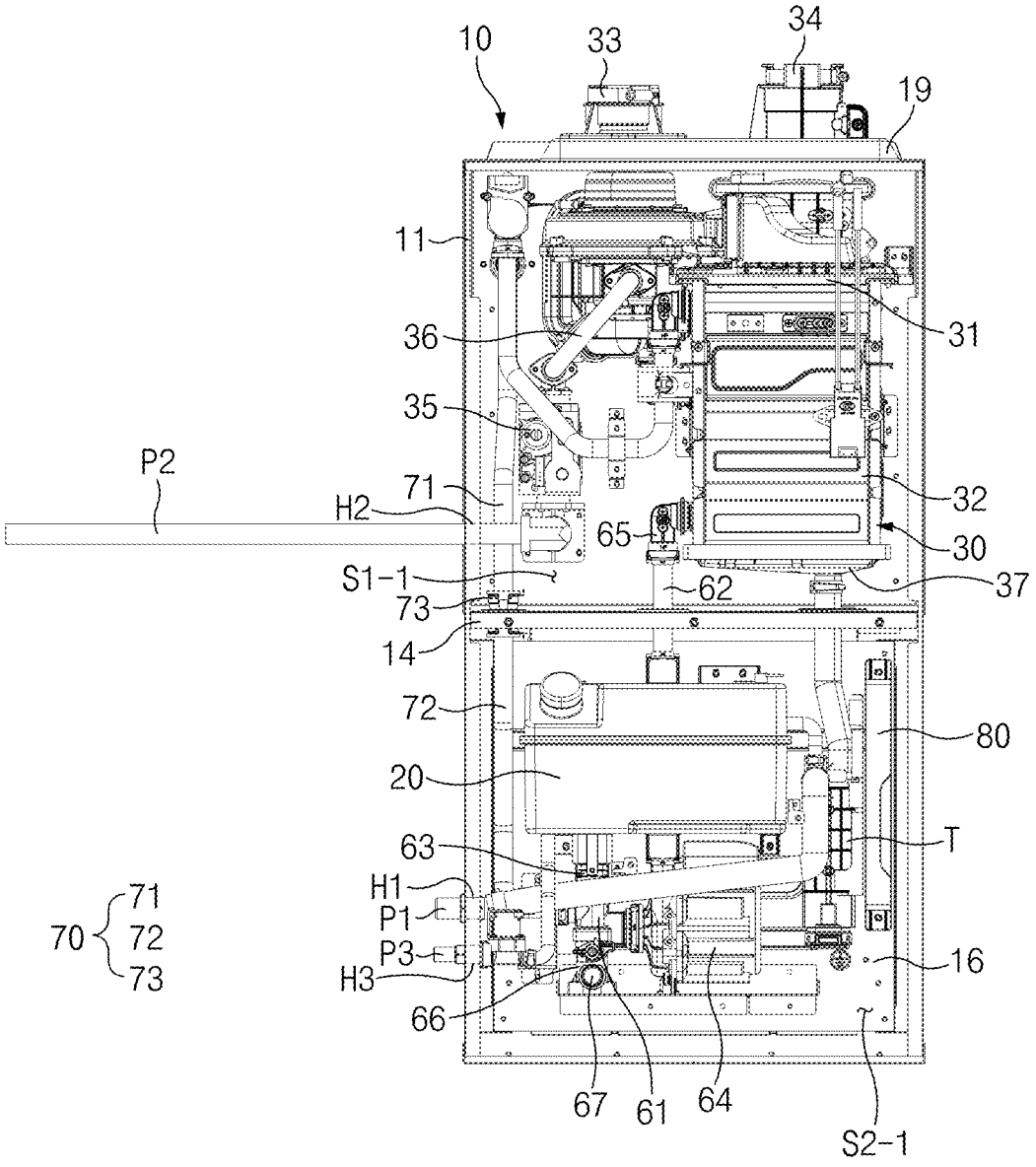
FIG. 3 is a view illustrating a state, in which a first opening cover of an air heating apparatus according to a first embodiment of the present disclosure is removed, when viewed from a reference direction.
Figure 4:
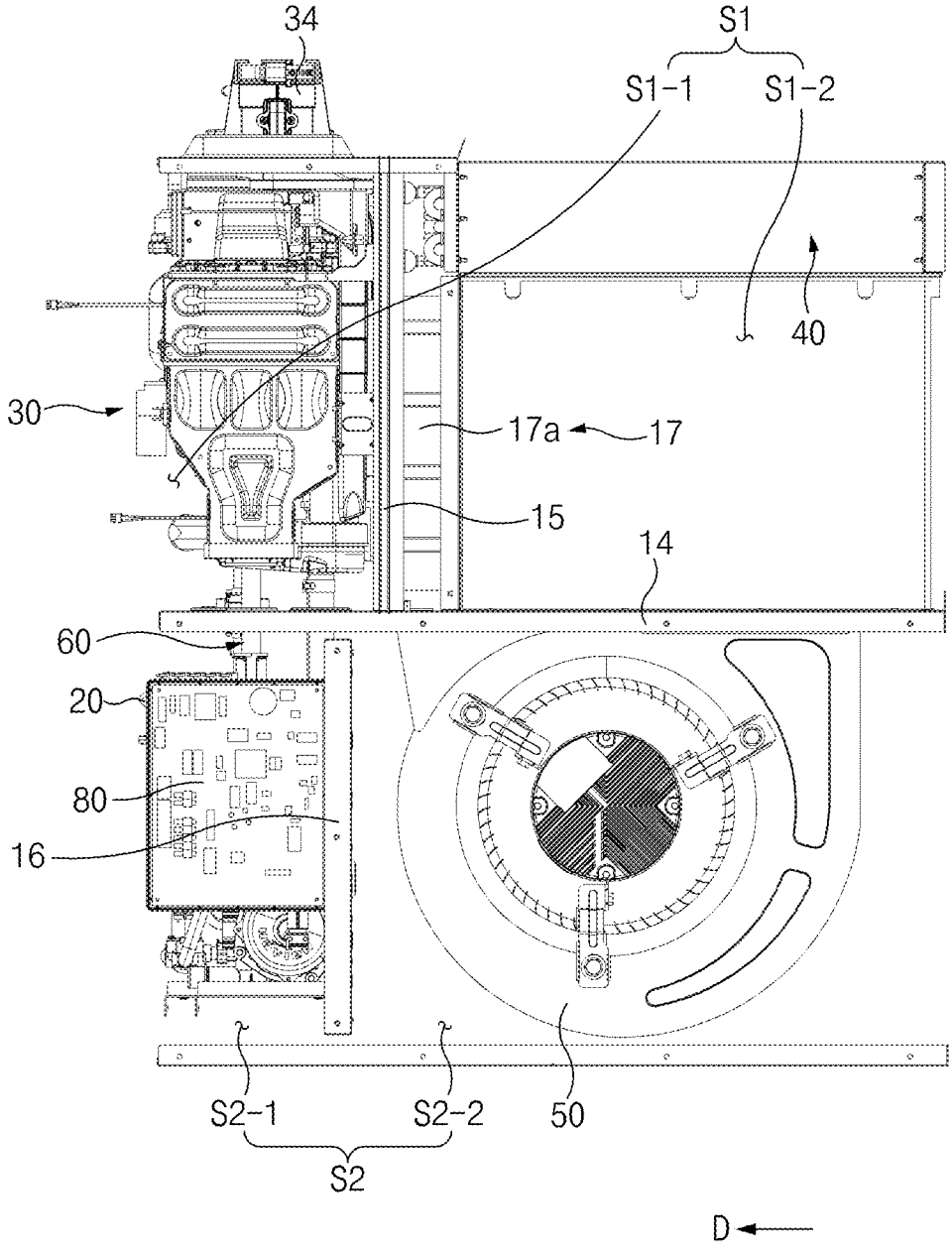
FIG. 4 is a view illustrating a state, in which an outer box of an air heating apparatus according to a first embodiment of the present disclosure is removed, when viewed from a direction that is perpendicular to an upward/downward direction and a reference direction.

First, basic components of an air heating apparatus according to a first embodiment of the present disclosure will be described in detail with reference to the drawings. FIG. 2 is a perspective view illustrating the air heating apparatus according to the first embodiment of the present disclosure. FIG. 3 is a view illustrating a state, in which a first opening cover of the air heating apparatus according to the first embodiment of the present disclosure is removed, when viewed from a reference direction. FIG. 4 is a view illustrating a state, in which an outer box of the air heating apparatus according to the first embodiment of the present disclosure is removed, when viewed from a direction that is perpendicular to an upward/downward direction and a reference direction. For reference, some configurations, such as the outer box, may be omitted in the illustrations of the drawings for convenience of description.

Referring to the drawings, the air heating apparatus 1 according to the first embodiment of the present disclosure may include a case 10, an expansion tank 20, a water heater 30, a heating heat exchanger 40, and a fan 50. In a brief description of an entire air heating mechanism, according to the air heating apparatus 1, water preserved in the expansion tank 20 is sent to the heating heat exchanger 40 after the water is heated in the water heater 30. The heated water sent to the heating heat exchanger 40 heats air sent from the fan 50, and the heated air is delivered to the rooms. Hereinafter, the components will be described in more detail.

<Case 10>

The expansion tank 20, the water heater 30, the heating heat exchanger 40, and the fan 50 may be disposed in an interior of the case 10. The case 10 may include an outer box 11, a first opening cover 13, a first partition wall 14, a second partition wall 15, and a third partition wall 16.

A first opening 12 may be formed in a reference direction "D" that is one direction that is perpendicular to the upward/downward direction of the outer box 11. As an example, the reference direction "D" may be a forward direction. The first opening cover 13 may be coupled to the outer box 11, and may cover the first opening 12 when being coupled to the outer box 11. The first opening cover 13 may be separated from the outer box 11 for repair of an interior of the air heating apparatus 1 later. As an example, the first opening cover 13 may include an upper end cover that covers an upper part of the first opening 12 with respect to the first partition wall 14, which will be described below, and a lower end cover that covers a lower part thereof. However, the present disclosure is not limited thereto, and one first opening cover 13 may have a shape that covers the entire first opening 12.

The first partition wall 14 may be coupled to the outer box 11, and may extend along the reference direction "D" to divide an interior of the outer box 11 to a first division space S1 and a second division space S2.

The second partition wall 15 may be disposed in the interior of the outer box 11 to be perpendicular to the first partition wall 14 and may divide the first division space S1 to a (1-1)-th division space S1-1 and a (1-2)-th division space S1-2. The second partition wall 15 may be separated from the interior of the outer box 11. This may mean that the second partition wall 15 is coupled to the interior of the outer box 11 to be separable.

The third partition wall 16 may be disposed in the interior of the outer box 11 to be perpendicular to the first partition wall 14 and may divide the second division space S2 to a (2-1)-th division space S2-1 and a (2-2)-th division space S2-2. This may mean that the interior of the case 10 is divided to four spaces in a 2 by 2 form. The third partition wall 16 may be separated from the interior of the outer box 11. This may mean that the third partition wall 16 is coupled to the interior of the outer box 11 to be separable.

As an example, a length of the (1-1)-th division space S1-1 along the upward/downward direction may correspond to a length of the (1-2)-th division space S1-2 along the upward/downward direction, and a length of the (2-1)-th division space S2-1 along the upward/downward direction may correspond to a length of the (2-2)-th division space S2-2 along the upward/downward direction. Here, the correspondence does not mean that they are the same, but has to be regarded as a concept including a case, in which they are in a specific proportional relationship. As an example, a ratio of the length of the (1-1)-th division space S1-1 along the upward/downward direction and the length of the (2-1)-th division space S2-1 in the upward/downward direction may be the same as a ratio of the length of the (1-2)-th division space S2-1 along the upward/downward direction and the length of the (2-2)-th division space S2-2 along the upward/downward direction. However, the present disclosure is not always limited thereto, and various modifications, for example, of a size of an internal part or an installation space thereof, may be made if necessary.

In this way, because the length of the (1-1)-th division space S1-1 along the upward/downward direction may correspond to the length of the (1-2)-th division space S1-2 along the upward/downward direction, and the length of the (2-1)-th division space S2-1 along the upward/downward direction may correspond to the length of the (2-2)-th division space S2-2 along the upward/downward direction, separation and mounting of the components may become easier whereby a customer service, such as repair and maintenance thereof, may be enhanced.

A length of the (1-1)-th division space S1-1 along the reference direction "D" may be smaller than a length of the (1-2)-th division space S1-2 along the reference direction "D". A length of the (2-1)-th division space S2-1 along the reference direction "D" may be smaller than a length of the (2-2)-th division space S2-2 along the reference direction "D". A length of the (1-1)-th division space S1-1 along the reference direction "D" may be smaller than a length of the (2-1)-th division space S2-1 along the reference direction "D". A length of the (1-2)-th division space S1-2 along the reference direction "D" may be smaller than a length of the (1-2)-th division space S1-2 along the reference direction "D".

Let's assume the lengths of the spaces along a direction that is perpendicular to the upward/downward direction and the reference direction as widths thereof. A width of the (1-1)-th division space S1-1 may be larger than or equal to a width of the (1-2)-th division space S1-2. A width of the (2-1)-th division space S2-1 may be larger than or equal to a width of the (2-2)-th division space S2-2. The width of the (1-1)-th division space S1-1 may correspond to the width of the (2-1)-th division space S2-1. The width of the (2-1)-th division space S2-1 may correspond to the width of the (2-2)-th division space S2-2.

When the width of the (1-1)-th division space S1-1 is larger than or equal to the width of the (1-2)-th division space S1-2 and the width of the (2-1)-th division space S2-1 is larger than or equal to the width of the (2-2)-th division space S2-2, a convenience of separation and mounting of a product for a service for a user may be enhanced.

As an example, the first division space S1 may be disposed on an upper side of the second division space S2. The water heater 30 may be disposed in the (1-1)-th division space S1-1. The heating heat exchanger 40 may be disposed in the (1-2)-th division space S1-2. The expansion tank 20 may be disposed in the (2-1)-th division space S2-1. The fan 50 may be disposed in the (2-2)-th division space S2-2. To deliver the air sent from the fan 50 to the heating heat exchanger 40, a passage, through which the air may pass, may be formed at a portion of the first partition wall 14, which is located between the (1-2)-th division space S1-2 and the (2-2)-th division space S2-2.

Meanwhile, the case 10 may include a contact part 17. The contact part 17 may include a first contact area 17*a* and a second contact area 17*b*. The first contact area 17*a* may be an area that contacts an inner surface of the outer box 11 and extends toward the reference direction "D". Here, the inner surface of the outer box 11 may be an inner surface that is located in a direction that is perpendicular to the reference direction "D" and the upward/downward direction. A rib for reinforcing strength may be famed in the first contact area 17*a*.

The second contact area 17*b* may be an area that protrudes from a distal end or the first contact area 17*a* in the reference direction "D" toward an inside of the outer box 11 and is coupled to opposite ends of the second partition wall 15. The opposite ends of the second partition wall 15 and the second contact area 17*b* may be screw-coupled to each other. However, the present disclosure is not always limited thereto, and various modifications, for example, of an adhesive or a magnet may be made.

A shape of the contact part 17, which is viewed from a top, may be similar to an "L" shape. Furthermore, a pair of contact parts 17 that are symmetrical to each other may be provided to be coupled to the opposite ends of the second partition wall 15.

Furthermore, a guide part 18 may be famed in the outer box 11. The guide part 18 may have a guide groove 18*a* that is opened toward the reference direction "D" such that opposite ends of the third partition wall 16 are inserted thereinto. A pair of guide parts 18 may have symmetrical shapes. A shape of the guide part 18, which is viewed from a top, may be similar to an "L" shape. Furthermore, a pair of contact parts 18 that are symmetrical to each other may be provided to be coupled to the opposite ends of the third partition wall 16. The guide part 18 may be coupled to a portion of the inner surface of the outer box 11, which is adjacent to the second division space S2.

Opposite ends of the third partition wall 16 may protrude toward the reference direction "D". Because the opposite ends of the third partition wall 16 protrude toward the reference direction "D", they may be precisely guided when being inserted into the guide groove 18*a*. The third partition wall 16 may be screw-coupled to the guide part 18. However, the coupling scheme is not limited to the above-described one.

A second opening that is opened upwards may be formed on an upper side of the outer box 11, and the case 10 may further include a second opening cover that is coupled to the outer box 11 and covers the second opening when being coupled to the outer box 11.

<Expansion Tank 20>

The expansion tank 20 may be configured to preserve water. The water may be introduced from an external water source. The expansion tank 20 may be formed to accommodate a change in a volume of the water according to a change in a temperature of the water. The expansion tank 20 may be connected to a main passage 60. The main passage 60 may be a passage that connects the expansion tank 20, the water heater 30, and the heating heat exchanger 40. That is, the water may be introduced into the heating heat exchanger 40 from the expansion tank 20 via the water heater 30. Accordingly, the main passage 60 may pass through the first partition wall 14. A main passage packing 68 (FIG. 11) may be disposed at a portion of the first partition wall 14, through which the main passage 60 passes. The main passage packing 68 may maintain a sealing state of a portion of the first partition wall 14, through which the main passage 60 passes.

A detailed shape of the main passage 60 will be described below.

The expansion tank 20 may accommodate expansion of the volume of the water that flows along the main passage 60. The expansion tank 20 may be of an open type.

When a temperature of the water is changed or the water is introduced or discharged in a state, in which the water is filled in the expansion tank 20, an internal pressure of the expansion tank 20 may be changed. Accordingly, the water accommodated in the expansion tank 20 may be provided to the other components along the main passage 60.

The expansion tank 20 may be connected to a water introducing pipe P1. The water introducing pipe P1 may connect the expansion tank 20 and a water source on an outside of the case 10 to introduce the water outside the case 10 into the expansion tank 20. To achieve this, the water introducing pipe P1 may pass through the case 10. As an example, the water introducing pipe P1 may pass through a wall of the case 10, which is adjacent to the (2-1)-th division space S2-1.

A water level detecting sensor that detects a level of the water in the interior of the expansion tank 20 may be disposed on an inner side of the expansion tank 20. The water level detecting sensor may be connected to a controller 80.

<Water Heater 30>

The water heater 30 is a component that is configured to heat and discharge the introduced water. For heating the water, the water heater 30 may cause a combustion reaction, and may transfer the heat generated through the combustion reaction to the water.

The water heater 30 may include a burner 31 and a heat exchange part 32. The burner 31 may cause the combustion reaction. Accordingly, the burner 31 may receive a fuel and air, and may form flames for the combustion reaction in a mixture of the fuel and the air by using an ignition plug. For the operation, the burner 31 may include a blower that sends the air, a fuel nozzle that ejects the fuel, and the ignition plug that generates sparks for ignition.

The burner 31 may further include a mixing chamber, and the fuel and the air may be mixed in the mixing chamber. Heat and a combustion gas are generated due to the combustion reaction, and the heat and the combustion gas may be delivered to the water. The fuel may be a natural gas, such as methane or ethane, which is used for power generation, and may be an oil, but a kind thereof is not limited thereto. The flames formed by the combustion reaction caused by the burner 31 may be disposed in an interior space of the combustion chamber located on a lower side of the burner 31. The combustion chamber may be a wet-type combustion chamber. As an example, a water pipeline, in which the water passes, may be disposed on a side surface of the combustion chamber in a form that surrounds a circumference of the side surface of the combustion chamber. In a process of dissipating the heat in the interior of the combustion chamber to an outside of the combustion chamber, some heat may be transferred to the water in the water pipeline.

To transfer the heat generated by the burner 31 to the water, the heat exchange part 32 is disposed. The heat exchange part 32 may be disposed on a lower side of the burner 31.

Meanwhile, the heat exchange part 32 may have an integral heat exchanger structure. The integral heat exchanger structure may mean a heat exchanger structure, in which thermal exchange media of different kinds are circulated. Because the heat exchange part 32 has the integral heat exchanger structure, the heat exchange part 32 may have a decreased entire height while maintaining performance as compared with a heat exchanger used for a general condensing boiler. Accordingly, in spite that an internal structure of the air heating apparatus 1 is narrow, the entire height of the water heater 30 may become smaller. Due to this, several components may be easily disposed in the interior of the air heating apparatus 1, and a size of the entire air heating apparatus 1 may become smaller.

The heat exchange part 32 may include a sensible heat exchanger and a latent heat exchanger. The sensible heat exchanger and the latent heat exchanger may be fin-tube type heat exchangers including fins and tubes, through which water flows, or plate type heat exchangers, in which a plurality of plates are stacked, but the kinds thereof are not limited thereto. The water introduced into the heat exchange part 32 may be heated sequentially via the latent heat exchanger and the sensible heat exchanger.

When the sensible heat exchanger and the latent heat exchanger are the fin-tube type heat exchangers, the fins may be plate-shaped and the tubes may pass through the fins. A plurality of fins may be disposed to be spaced apart along an extension direction of the tubes. The combustion gas may flow through spaces between the fins and between the tubes, and the water may flow through the interiors of the tubes whereby heat may be exchanged between the water and the combustion gas.

The tube may have a slotted shape, an interior space of which is formed long along an upward/downward direction in a cross-section taken by a plane that is perpendicular to the extension direction of the tube. The interior space of the tube may be formed such that a value obtained by dividing a height in the upward/downward direction in the above-described cross-section by a width in a forward/downward direction that is perpendicular to the upward/downward direction is larger than 2.

The sensible heat exchanger is configured to receive the heat generated through the combustion reaction and heat the water that flows through an interior thereof. Accordingly, the sensible heat exchanger may be disposed to be adjacent the burner. The sensible heat exchanger may not be interrupted by the flames and the combustion gas may pass through the sensible heat exchanger.

The sensible heat exchanger is configured to heat the water that flows through the interior thereof by using latent heat of the combustion gas generated through the combustion gas. Because the latent heat exchanger uses the latent heat of the combustion gas, the heat generated by the combustion gas is transferred to the water that flows in an interior of the latent heat exchanger when moisture included in the combustion gas is condensed. Accordingly, the latent heat exchanger may be disposed after the sensible heat exchanger with respect to a flow direction of the combustion gas whereby the combustion gas, a temperature of which has been lowered as the heat is transferred to the water in the sensible heat exchanger arrives and is condensed. The tubes included in the latent heat exchanger may be disposed at different locations along the flow direction of the combustion gas to generate a plurality of heats.

The sensible heat exchanger and the latent heat exchanger may be disposed in the main passage 60 such that the water is introduced into the sensible heat exchanger via the latent heat exchanger. Accordingly, the water may be secondarily heated in the sensible heat exchanger after being primarily heated in the latent heat exchanger and may be delivered to the heating heat exchanger 40, which will be described below.

The water heater 30 may further include a sensible heat insulating pipeline on an outside of the sensible heat exchanger. The sensible heat insulating pipeline is a pipeline, in which heating water flows along an interior thereof and which directly or indirectly contacts the sensible heat exchanger whereby the sensible heat exchanger is insulated.

In the water heater 30, the burner 31, the sensible heat exchanger, and the latent heat exchanger may be sequentially disposed as they go from an upper side to a lower side. Accordingly, then, the combustion gas may flow to a lower side. However, the flow direction is not limited thereto.

The heat exchange part 32 may include a heat exchange housing, and may be configured such that the sensible heat exchanger and the latent heat exchanger are disposed in an interior thereof. The combustion gas may exchange heat with the water that passes through the tubes of the heat exchangers while passing through a space that is located in an interior of the heat exchange housing.

Let's define a cross-sectional area in a cross-section that is obtained by cutting the interior space of the heat exchange housing by a plane that is perpendicular to the flow direction of the combustion gas as a reference cross-sectional area. The heat exchange housing may include a tapered area, the reference cross-sectional area decreases as it goes along the flow direction of the combustion gas, and a section, the reference cross-sectional area does not decrease. With respect to the flow direction of the combustion gas, the reference cross-sectional area at a downstream side distal end of the heat exchange housing may be smaller than the reference cross-sectional area at an upstream side distal end thereof. With respect to the flow direction of the combustion gas, the reference cross-sectional area at an upstream side distal end of the latent heat exchanger may be smaller than the reference cross-sectional area at a downstream side distal end of the sensible heat exchanger. Accordingly, a degree, by which a flow velocity of the combustion gas decreases when it flows from the sensible heat exchanger to the latent heat exchanger, becomes lower than a case, in which the reference cross-section is constant whereby the condensate located between the fins or between the tubes may be pushed out. Accordingly, a structure of the heat exchange housing may prevent a thermal efficiency thereof from being decreased as the condensate causes a delay of the flow of the combustion gas in the latent heat exchanger. The fins of the heat exchangers may be formed according to a shape of the interior space of the heat exchange housing.

A sequence, in which the water flows, will be described below, starting from the heat exchange part 32. The water may be introduced first to the latent heat exchanger of the heat exchange part 32, and the water may condense vapor of the combustion gas that flows around the latent heat exchanger, and may receive the latent heat generated in the condensing process to be heated. The water heated in the latent heat exchanger may be heated while being delivered to the sensible heat exchanger to receive the heat generated through the combustion reaction. The water heated in the heat exchange part 32 may be delivered to the heating heat exchanger 40. The water delivered to the heating heat exchanger 40 may transfer heat to the air that passes through the heating heat exchanger 40 to cool the air.

The heat exchange housing may include left and right side surfaces, and a passage cap plate that covers the left and right side surfaces. The passage cap plate is a plate including a passage cap that defines an interior space together with the left and right side surfaces of the heat exchange housing, through which the tubes pass, as it covers the left and right side surfaces thereof. The plurality of passage caps and the tubes may be communicated with each other whereby passages, in which the water flows, may be formed in the heat exchange part 32. The passages formed in the heat exchange part 32 by the plurality of passage caps and the tubes may include a parallel section and a series section.

The water heater 30 may include a condensate receiver 37 that is disposed on a downstream side of the latent heat exchanger along the flow direction of the combustion gas. When the condensate generated in the latent heat exchanger drop to a vertically lower side by a self-weight thereof, the condensate receiver 37 may collect the condensate.

The condensate receiver 37 may be coupled to a condensate discharge pipe P3 to be separable. The condensate receiver 37 may have an inner surface that is inclined toward the condensate discharge pipe P3 such that the collected condensate is discharged through the condensate discharge pipe P3 that extends to a vertically lower side. A condensate trap "T" that discharges the condensate while preventing the combustion gas from being discharged through the condensate discharge pipe P3 may be disposed in the condensate discharge pipe P3. The condensate trap "T" may be a ball type trap, and a neutralizer that neutralizes the condensate before the condensate is discharged may be embedded therein.

The condensate discharge pipe P3 may pass through the case 10 to be exposed to an outside of the case 10. As an example, the condensate discharge pipe P3 may pass through a wall of the case 10, which is adjacent to the (2-1)-th division space S2-1.

Furthermore, the condensate discharge pipe P3 may pass through the first partition wall 14. A condensate packing 38 (FIG. 11) may be disposed at a portion of the first partition wall 14, through which the condensate discharge pipe P3 passes. The condensate packing 38 may maintain a sealing state of the portion of the first partition wall 14, through which the condensate discharge pipe P3 passes.

Furthermore, the water heater 30 may include an exhaust duct such that the residual combustion gas is discharged at the same time when the condensate is discharged. The exhaust duct may be communicated with the condensate receiver 37. The exhaust duct is formed to extend to a vertically upper side whereby the residual combustion gas is discharged to an outside.

An air supply hole 33 for supplying exterior air to the water heater 30 may be formed to pass through an upper wall of the case 10. The air introduced through the air supply hole 33 may be provided to the burner 31 of the water heater 30. The combustion gas generated through the combustion reaction of the water heater 30 may be delivered to a gas discharge hole 34 formed to pass through the upper wall of the case 10 through the exhaust duct and may be discharged to an outside. Because the combustion gas is discharged through the gas discharge hole 34 after being located only in the water heater 30, there is no concern about the combustion gas being mixed with the air supplied to the rooms.

As an example, the air supply hole 33 and the gas discharge hole 34 may be formed in an area of a second opening cover 19 of the case 10, which protrudes upwards. Then, the area of the second opening cover 19, which protrudes upwards, also may function to provide a space that may accommodate an increased height of the exchanged water heater when the water heater is exchanged even when the height of the exchanged water heater is increased.

Meanwhile, a fuel introducing pipe P2 for providing a fuel to the air heating apparatus 1 may be disposed to pass through the case 10. As an example, the fuel introducing pipe P2 may pass through a wall of the case 10, which is adjacent to the (1-1)-th division space S1-1. The fuel introducing pipe P2 may be a pipe that connects the water heater 30 and a fuel tank on an outside of the case 10 such that the fuel outside the case 10 is introduced into the water heater 30.

The fuel introducing pipe P2 may be connected to the burner 31 by a medium of a venturi 36. The fuel introducing pipe P2 and the venturi 36 may be connected to each other by a medium of a fuel valve 35. As the fuel valve 35 is selectively opened and closed, it may be determined whether the fuel is to be supplied to the burner 31. The fuel valve 35 may be electrically connected to the controller 80.

<Heating Heat Exchanger 40>

The heating heat exchanger 40 is a component that is configured to exchange heat between the water and the air. The heating heat exchanger 40 may be configured to receive the water and exchange heat with the air that is to be discharged for heating. For a description of the heating heat exchanger, FIG. 8 that will be described below may be referenced.

The heating heat exchanger 40 may be disposed to be adjacent to the upper wall of the case 10. The heating heat exchanger 40 may include a heat exchange tube 42, in which the water heated by the water heater 30 flows. The heat exchange tube 42 may define a passage that has a pipe shape such that the water flows through an interior thereof and the air sent by the fan 50 flows through an outside and is curved in a forward/rearward direction and in a leftward/rightward direction. The heat exchange tube 42 may be formed of a material including aluminum and copper.

The heat exchange tube 42 may be formed of the above-described material, and is configured such that the water flows through an interior thereof, and the following effects may be expected. Unlike a pipeline of a conventional gas furnace, which may expose a combustion gas due to cracks as it experiences excessive thermal expansion and thermal contraction due to the flows of the combustion gas and air to an interior and an exterior thereof, the present disclosure may remarkably reinforce safety because a danger of generating cracks is reduced and not air in the combustion gas but water is leaked even though cracks are caused. Furthermore, because the water and the air exchange heat through the heat exchange tube 42 in the heating heat exchanger 40 of the present disclosure, the air is heated while a humidity thereof is maintained whereby a separate humidity adjusting device is not required.

The heat exchange tube 42 may include a plurality of layers that are disposed at different locations along the upward/downward direction. Although it is illustrated and described that the heat exchange tube 42 includes four layers in the present disclosure, the number of the layers is not limited thereto. Furthermore, the heat exchange tube 42 may be formed in forms, in which four layers are all connected to each other in series and they are connected to each other in series and in parallel.

The heat exchange tube 42 may include linear members 421 that extend in the forward/rearward direction, and a connection member that connects distal ends of the adjacent linear members 421. The connection member may include same layer connecting members 422 and different layer connecting members 423. The plurality of linear members 421 may be arranged along the leftward/rightward direction, and the plurality of same layer connecting members 422 may be disposed at front and rear ends of the linear members 421 such that passages may be formed by connecting the distal ends of the adjacent linear members 421. The plurality of different layer connecting members 423 may form passages by connecting the distal ends of the linear members 421 located on the adjacent layers. The connecting members may have a "U" shape.

The heating heat exchanger 40 may further include a distribution pipe 44. The distribution pipe 44 may be configured to receive water from the water heater 30 and distribute the water to the layers including the heat exchange tubes 42. The distribution pipe 44 may include a distribution delivery pipe 441 and a distribution head 442. The distribution delivery pipe 441 may be connected to the main passage 60 to receive the water heated through the heat exchange part 32, and the water flows in the distribution head 442 connected to the distribution delivery pipe 441. The distribution head 442 may extend in the leftward/rightward direction and may be connected to the plurality of linear members 421. Accordingly, by the distribution head 442, a parallel passage including a plurality of partial passages, of which inlets and outlets are common, may be formed. Here, an inlet of the parallel passage may be the distribution head 442. The entire passage formed by the heat exchange tubes 42 may include a section including the above-described parallel passage.

Then, the linear members 421, to which the distribution head 442 is connected, may be, among the layers formed by the heat exchange tubes 42, the linear member 421 located on the uppermost side. The water is delivered to the uppermost layer of the heat exchange tubes 42, and the water flows to the lowermost layer along the layers formed by the heat exchange tubes 42. In the process, the water may transfer the heat to the air that passes around the heat exchange pipeline. That is, a direction, in which the air sent by the fan 50 flows in the heating heat exchanger 40 is an upward direction and a direction, in which the water flows as a whole, is a downstream side that is an opposite direction thereto whereby a counter-flow structure may be provided.

The heating heat exchanger 40 may further include a collection pipe 45 that returns the water, which has transferred the heat to the air, to the water heater 30. The collection pipe 45 may include a collection delivery pipe 451 and a collection head 452. The heat exchange tubes 42 are connected to the collection head 452, and the cooled water may be delivered to the collection head 452. The collection head 452 may be connected to the collection delivery pipe 451, and may deliver the cooled water to a recovery passage 70 connected to the collection delivery pipe 451. The collection head 452 may extend in the leftward/rightward direction and may be connected to the plurality of linear members 421. Accordingly, because the collection head 452 becomes an outlet of the parallel passage and the parallel passage ends at the collection head 452 whereby the water may gather at the collection head 452. Then, the linear parts, to which the collection head 452 is connected, may be, among the layers formed by the heat exchange tubes 42, linear parts that are located on the lowermost layer.

The heating heat exchanger 40 crosses the heat exchange tubes 42, and may have a plurality of heat transfer fins 43, through which the heat exchange tubes 42 pass. The heat transfer fins 43 may have plate shapes that are perpendicular to the forward/rearward direction and are arranged along the forward/rearward direction to deliver the heat of the water that flows inside the heat exchange tubes 42 to ambient air better. Along the upper side, the air may pass between the heat exchange tubes 42 and the heat transfer fins 43. The heat transfer fins 43 and the heat exchange tubes 42 may be fixed by a heating heat exchange housing 41. The heat transfer fins 43 may be disposed in the heating heat exchange housing 41. The heating heat exchange housing 41 may be fixed to the case 10.

<Fan 50>

The fan 50 is configured to send the air to the heating heat exchanger 40. The fan 50 may be disposed on a lower side of the heating heat exchanger 40 such that the air is sent to the upper side to pass through the heating heat exchanger 40, and an outlet thereof, from which the air is discharged, may be disposed to face the upper side. The fan 50 may include components, such as a motor and blades, and may be electrically connected to the controller 80. Accordingly, the fan 50 may be electrically connected to be operated such that the air is sent as the motor rotates the blades. The fan 50 may include an impeller and the like, and may pump the air.

A length of the fan 50 along the reference direction "D" may be smaller than a length of the (2-1)-th division space S2-1 along the reference direction "D". Furthermore, a length of the fan 50 along the upward/downward direction may be smaller than a length of the (2-1)-th division space S2-1 along the upward/downward direction. An air sending space that is an empty space may be formed between the fan 50 and the heating heat exchanger 40 in the interior space of the case 10.

A process of circulating the air will be described as follows, starting from the fan 50. The air introduced to the fan 50 may be sent upwards. The sent air passes through the heating heat exchanger 40. The air may receive heat from the water that passes via the heating heat exchanger 40 to be heated while passing through the heating heat exchanger 40. The heated air may be discharged to an outside of the case 10, and may be sent to the rooms of the house through the duct 3. The air sent to the rooms or the cooled air introduced from the outside into the house may be introduced into the interior of the case 10 again, and may enter an inlet of the fan 50.

Hereinafter, the main passage 60 and the recovery passage 70 that connect the components will be described in detail. The main passage 60 may be a passage that connects the expansion tank 20, the water heater 30, and the heating heat exchanger 40. The recovery passage 70 may mean a passage that connects the heating heat exchanger 40 and a first part 61 of the main passage 60, which will be described below, to guide the water introduced into the heating heat exchanger 40 to the first part 61. Accordingly, the recovery passage 70 may pass through the first partition wall 14. Meanwhile, the passage may mean a path formed by connecting inner parts of the components, in which a fluid flows, by a pipe or a hose, in which the fluid flows through interiors thereof, such that the fluid flows therethrough.

<Main Passage 60>

The main passage 60 may include the first part 61 and a second part 62. The first part 61 may be a part that extends downwards from the expansion tank 20. The first part 61 may be a part for discharging water from the expansion tank 20. A filter part 63 may be disposed in the first part 61. The filter part 63 may be disposed in the first part 61 to filter the water that passes through the first part 61.

The second part 62 may be a part that is communicated with the first part 61 and the expansion tank 20, extends from the expansion tank 20, and one end of which extends upwards to be connected to the water heater 30. A pump part 64 may be disposed in the second part 62. The pump part 64 may be disposed in the second part 62 to pump the water that passes through the second part 62 to the water heater 30. As an example, the second part may have a shape that is similar to the "U" shape. Here, the "U" shape means a similarity in the shape that is opened upwards, and does not always mean that the lengths of the opposite sides that extend upwards are the same.

The pump part 64 may be electrically connected to the controller 80. The pump part 64 may be a variable capacity pump that may change a pressure applied to the water. Accordingly, the controller 80 may control the pump part 64 for a change in a flow rate of the water that flows along the main passage 60.

Meanwhile, a through-hole having a pipe shape that extends upwards and downwards may be formed in the expansion tank 20. The second part 62 may have a shape that passes through the through-hole of the expansion tank 20. In summary, the second part 62 may have shape that passes through the through-hole of the expansion tank 20, and one end thereof may be connected to the water heater 30. Furthermore, an opposite end thereof may be communicated with the expansion tank 20. A "U"-shaped pipe may be formed between the opposite end and the one end of the second part 62.

Hereinafter, the components that may be additionally provided will be continuously described in detail. The components that may be additionally may be the controller 80 and a sealing part 90.

<Controller 80>

The controller 80 is configured to control a temperature of the water that passes through the heating heat exchanger 40 through the main passage 60 and returns to the water heater 30. The controller 80 may include a processor and a memory. The processor is a component including an element that may perform logical calculations for performing a control command, and may include a central processing unit (CPU). The processor may be connected to various components to deliver signals corresponding to the control command to the components to perform a control, and may be connected to various sensors or acquisition parts to receive the acquired information in a form of signals. Accordingly, in the first embodiment of the present disclosure, the processor may be electrically connected to various components included in the air heating apparatus 1. The processor may be electrically connected to the components, and thus may communicate with them with a communication module that is connected thereto by wires or may perform wireless communication.

Because the processor is electrically connected to the components of the integral air heating apparatus 1 according to the first embodiment of the present disclosure to perform calculations by using the received information and deliver the control signals, the components may be controlled in an optimum state and the components may automatically interwork with each other to be operated. Furthermore, because information or control data acquired from the water and the air that circulate as will be described below are acquired in real time and is controlled in an integrated way due to the integral interworking control of the processor, a uniform efficiency may be maintained and optimum setting that is suitable for the entire system may be automatically made.

The control commands performed by the processor may be stored in the memory to be utilized. The memory may be devices, such as a hard disk drive (HDD), a solid state drive (SSD), a server, a volatile medium, or a nonvolatile medium, but a kind thereof is not limited thereto. The memory may, in addition, further store data that is necessary for performing an operation and the like.

The controller 80 may be disposed in the (2-1)-th division space S2-1. A manipulation part 81 including a display, a button, and the like, which may be manipulated for manipulating the controller 80 by the user may be disposed in the first opening cover 13.

The controller 80 may control a temperature of the returning water by controlling the flow rate of the water that flows in the main passage 60. When a control is made such that a flow rate of the water that flows in the main passage 60 is decreased, the water may flow in the heating heat exchanger 40 for a longer time period as compared with the other cases and thus a higher calorie may be delivered to the air whereby the temperature of the returning water will be decreased. In contrast, when the flow rate of the water that flows in the main passage 60 is controlled to be increased, the temperature of the returning water will be increased as compared with the other case.

The controller 80 may be electrically connected to the burner 31, and the calorie that is delivered to the water may be adjusted by controlling it. The burner 31 may include a blower that sends the air to mix the fuel and the air for use for a combustion, and the controller 80 may adjust the flow rate of the air that is provided to a part, in which flames are generated, by adjusting a rotational speed of the blower.

Because the flow rate of the air is adjusted, the calorie generated in the water heater 30 through the combustion reaction may be adjusted. Accordingly, the air heating apparatus 1 according to the first embodiment of the present disclosure may have a turn-down ratio of 6:1 to 10:1, and thus may maintain a constant efficiency by properly adjusting the calorie or the flow rate of the water according to an operation situation having different loads, such as a low-load operation and a high-load operation.

Meanwhile, an external interworking controller 82 (FIG. 13) may be further disposed in the (2-1)-th division space S2-1. The external interworking controller 82 may be disposed to be adjacent to the first opening cover 13 of the case 10. The external interworking controller 82 may send and receive data to and from the devices, such as a thermostat in the house, which are located on an outside of the air heating apparatus. The external interworking controller 82 may deliver the data acquired from the devices located on the outside to the controller 80. The controller 80 may perform the above-described controls based on the data received from the external interworking controller 82.

<Sealing Part 90>

Figure 5:
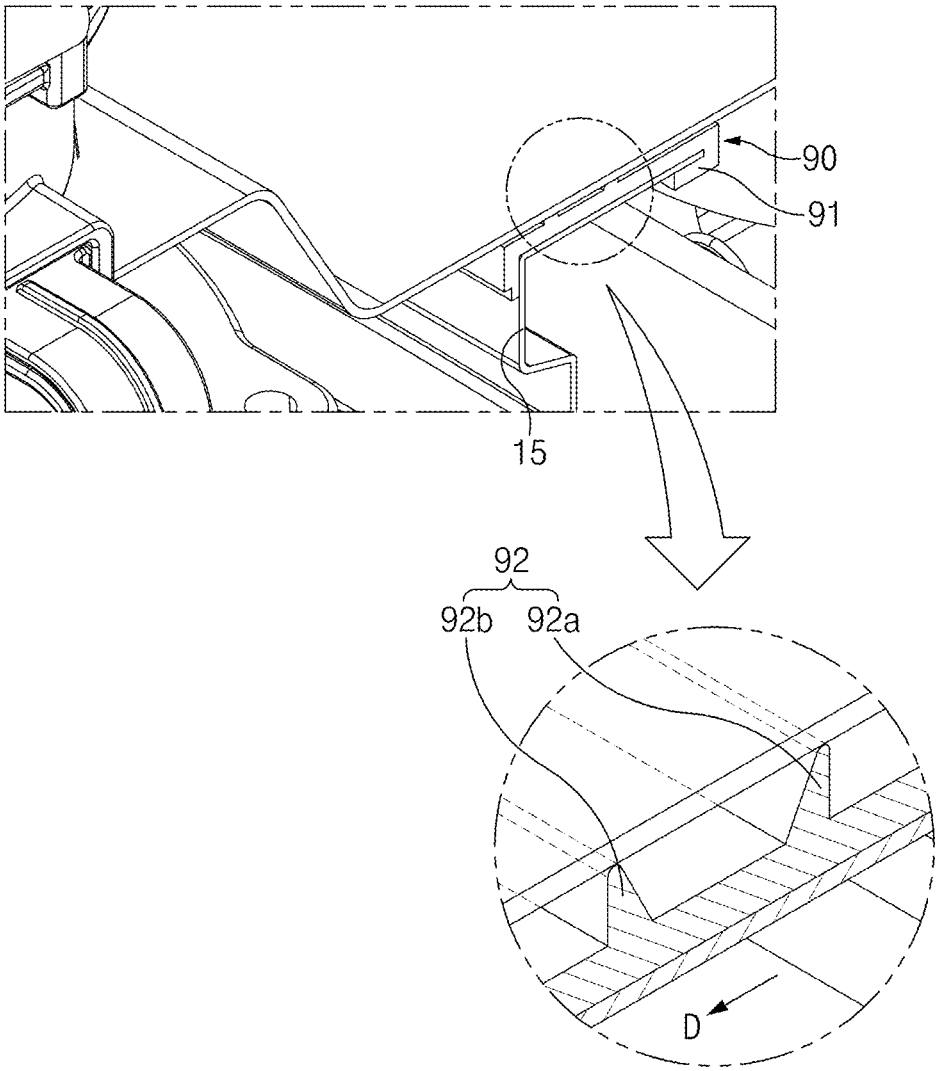
FIG. 5 is a view illustrating cross-sections of a sealing part and a second division part and an enlarged view of the cross-sections together.

FIG. 5 is a view illustrating cross-sections of the sealing part and the second division part and an enlarged view of the cross-sections together. The sealing part 90 may be disposed between the second partition wall 15 and the outer box 11 to maintain a sealing state between the (1-1)-th division space S1-1 and the (1-2)-th division space S1-2. The sealing part 90 may be formed of an ethylene-propylene diene monomer (EPDM) material.

The sealing part 90 may include a sealing member 91 and a boss member 92. The sealing member 91 may surround a periphery of the second partition wall 15. As an example, a protruding area that extends along an opposite direction to the reference direction "D" may be formed at a periphery of the second partition wall 15, and the sealing member 91 may be configured to surround the protruding area. To surround the protruding area, the sealing member 91 may have an area, a cross-section of which is similar to a "C" shape. This may mean that the sealing member 91 has an area that is opened toward the reference direction "D". Furthermore, the sealing member 91 has an area, a thickness of which is changed.

For example, it may be considered that the protruding area is formed to extend from a periphery of the second partition wall 15 along the reference direction "D". Then, the sealing member 91 has an area that is opened toward an opposite direction to the reference direction "D". In this case, because the second partition wall is assembled along the opposite direction to the reference direction when the second partition wall 15 is assembled, the sealing member 91 that surrounds the protruding area may be separated by a frictional force generated in the reference direction in this process.

Because the protruding area of the air heating apparatus according the present disclosure has a shape that extends from a periphery of the second partition wall 15 along the opposite direction to the reference direction "D", the sealing member 91 has an area that is opened toward the reference direction "D". When the second partition wall 15 is assembled, it is assembled according to opposite direction to the reference direction "D", and thus a danger of the second partition wall 15 being separated in an assembling process may become lower.

The boss member 92 may protrude to an outside of the sealing member 91, and may contact the outer box 11. The boss member 92 may have a shape that is tapered along an extension direction of the boss member 92. As an example, a shape of the boss member 92 when the boss member 92 is cut by a cross-section that is parallel to the reference direction "D" may be a shape that is tapered along the extension direction of the boss member 92.

The boss member 92 may include a first boss 92*a* and a second boss 92*b*. The second boss 92*b* may be spaced apart from the first boss 92*a* along the reference direction "D", and may extend in a direction that crosses a direction, in which the first boss 92*a* extends.

Because the air heating apparatus 1 according to the first embodiment of the present disclosure includes the sealing part 90, it may prevent carbon monoxide and harmful substances that may be generated due to burn out of internal parts of the water heater 30 from residing inside the air heating apparatus 1 or being transited to a space, in which the heating heat exchanger 40 is located, to be included in the air supplied into the interiors of the rooms.

The parts of air heating apparatus 1 according to the first embodiment of the present disclosure may be arranged in one module to be separable, and thus the internal parts may be easily repaired. Hereinafter, the features of the present disclosure that may achieve the effects will be described in detail. The parts may be separated at the same time when the second partition wall 15 and the third partition wall 16 are separated from each other. The first opening cover 13 may be separated before the second partition wall 15 and the third partition wall 16 are separated from each other.

Figure 6:
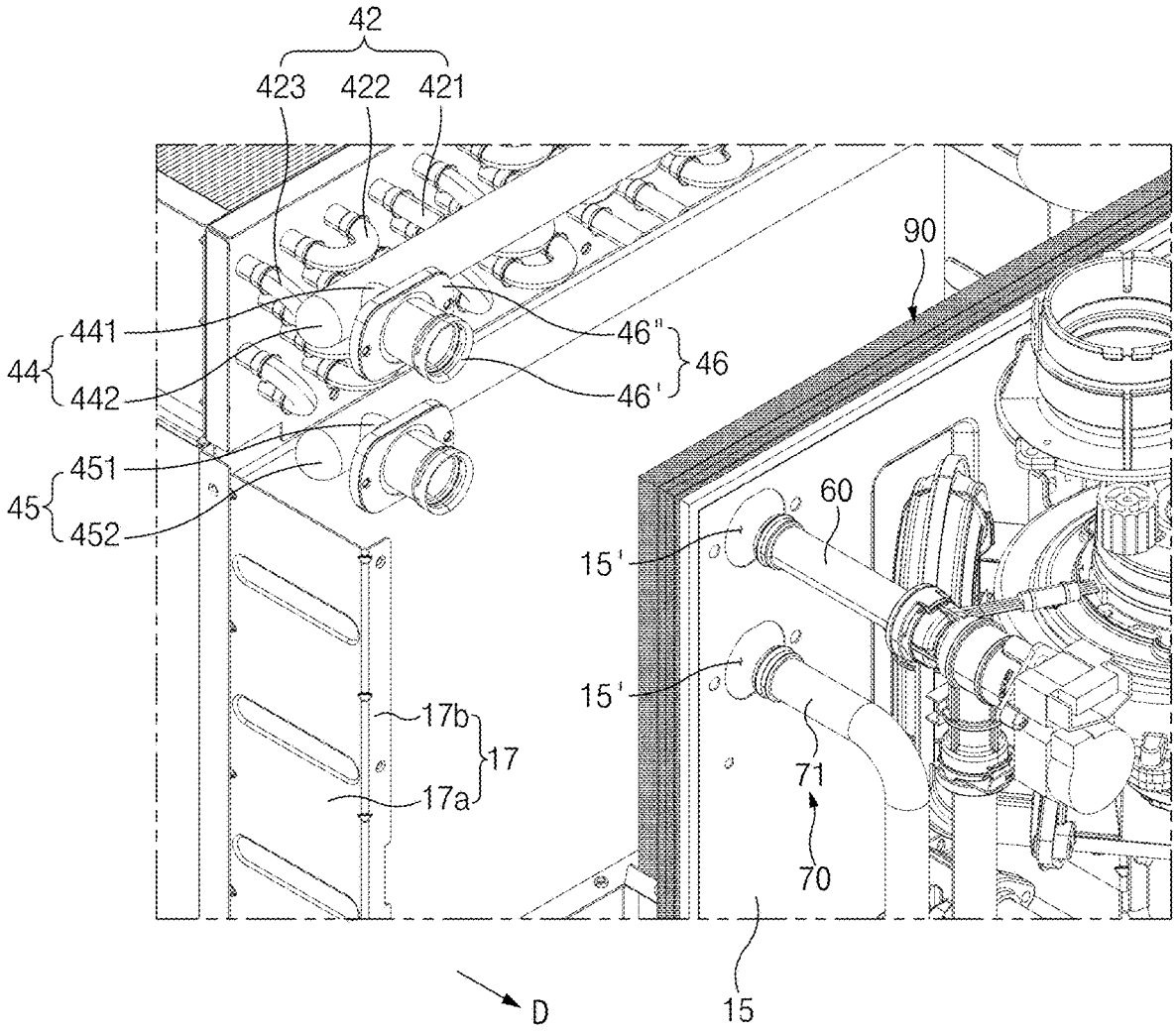
FIG. 6 is an enlarged view illustrating a state, in which a second partition wall and a heating heat exchanger are separated from each other.
Figure 7:
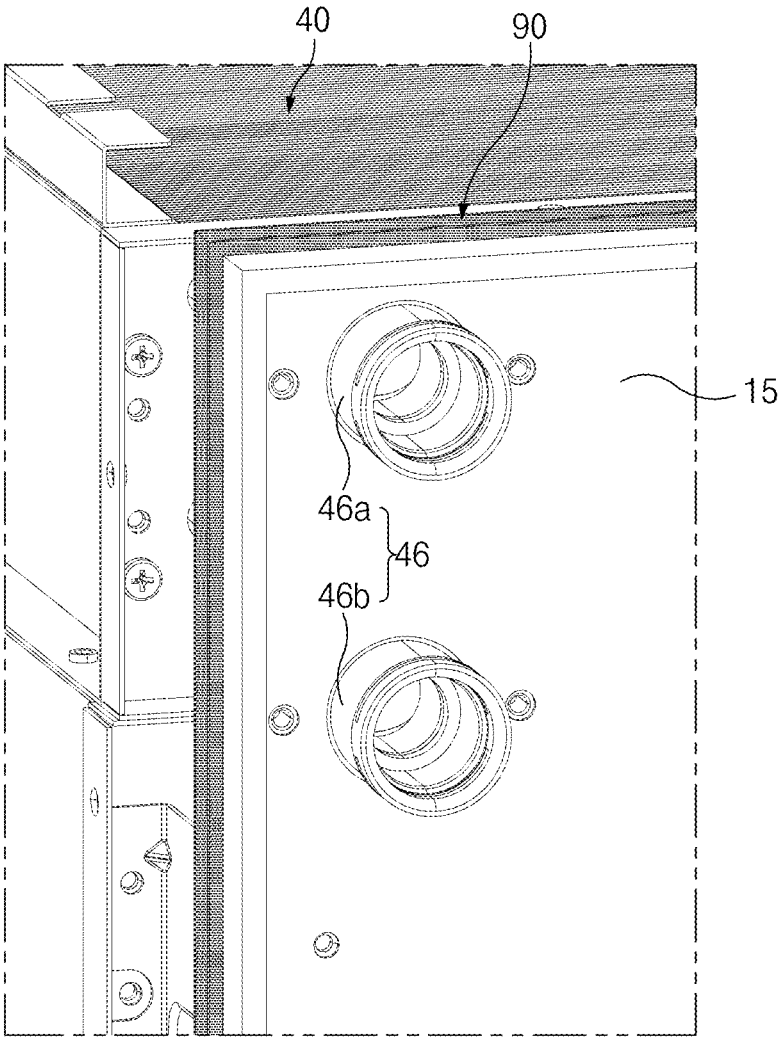
FIG. 7 is an enlarged view illustrating a state, in which a second partition wall and a heating heat exchanger are separated from each other.
Figure 9:
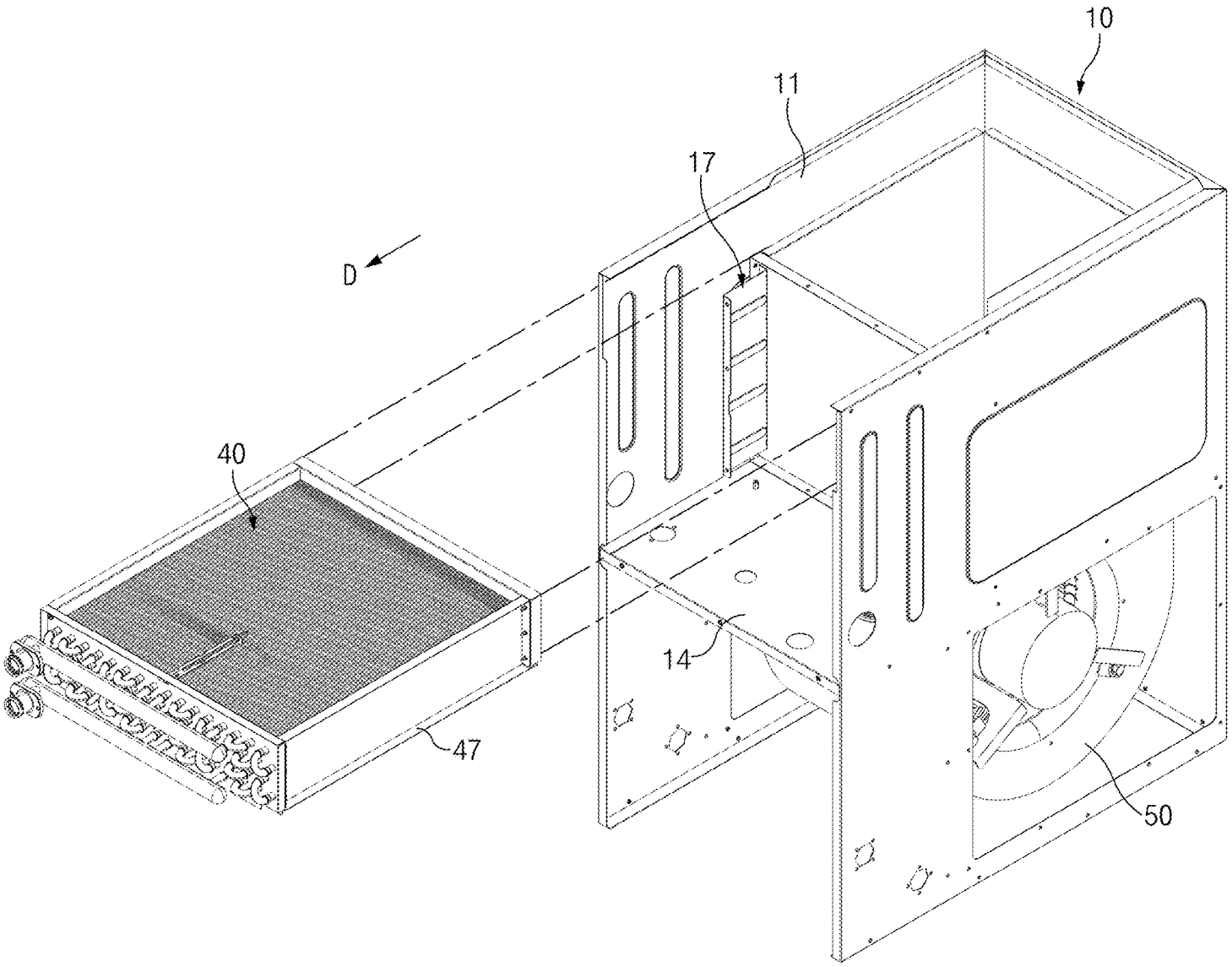
FIG. 9 is a view illustrating a state, in which a heating heat exchanger is separated from an outer box.
Figure 10:
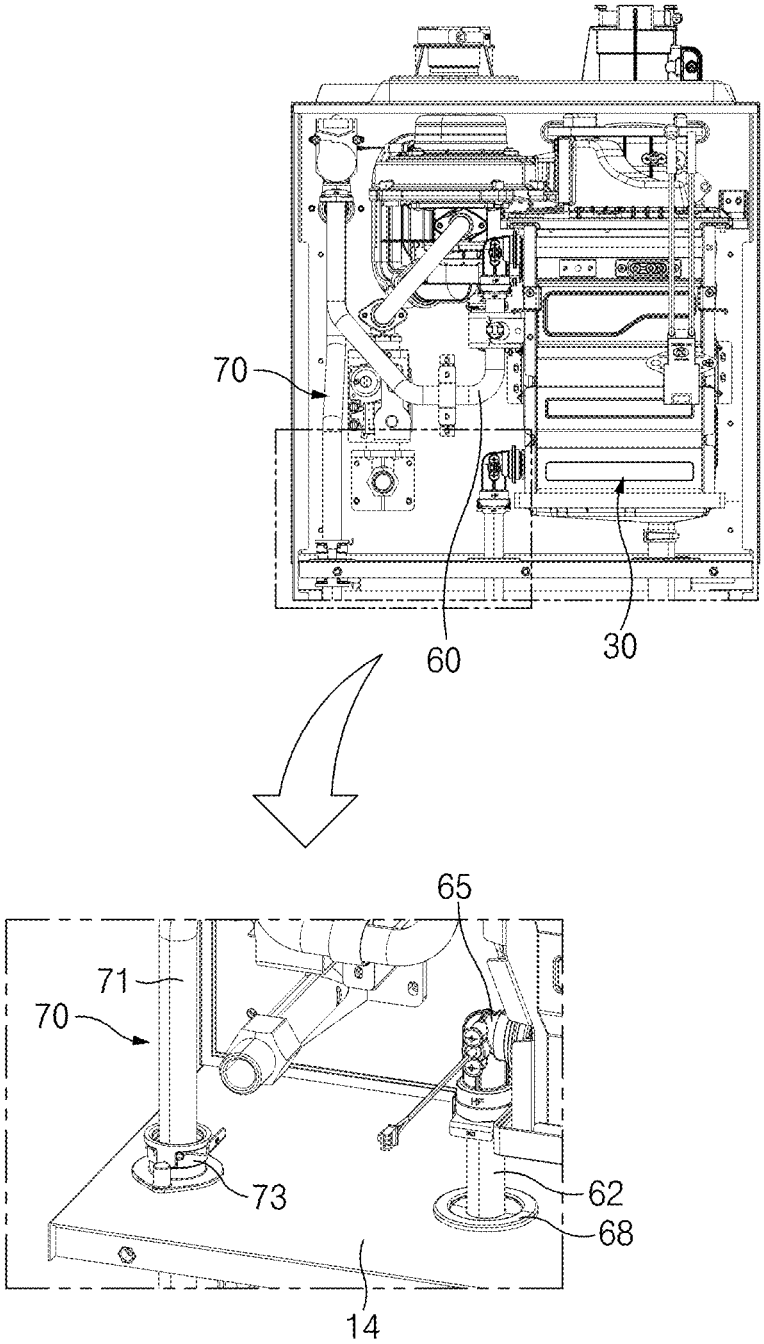
FIG. 10 is a view illustrating a (1-1)-th division space and an enlarged view of a lower side thereof.
Figure 11:
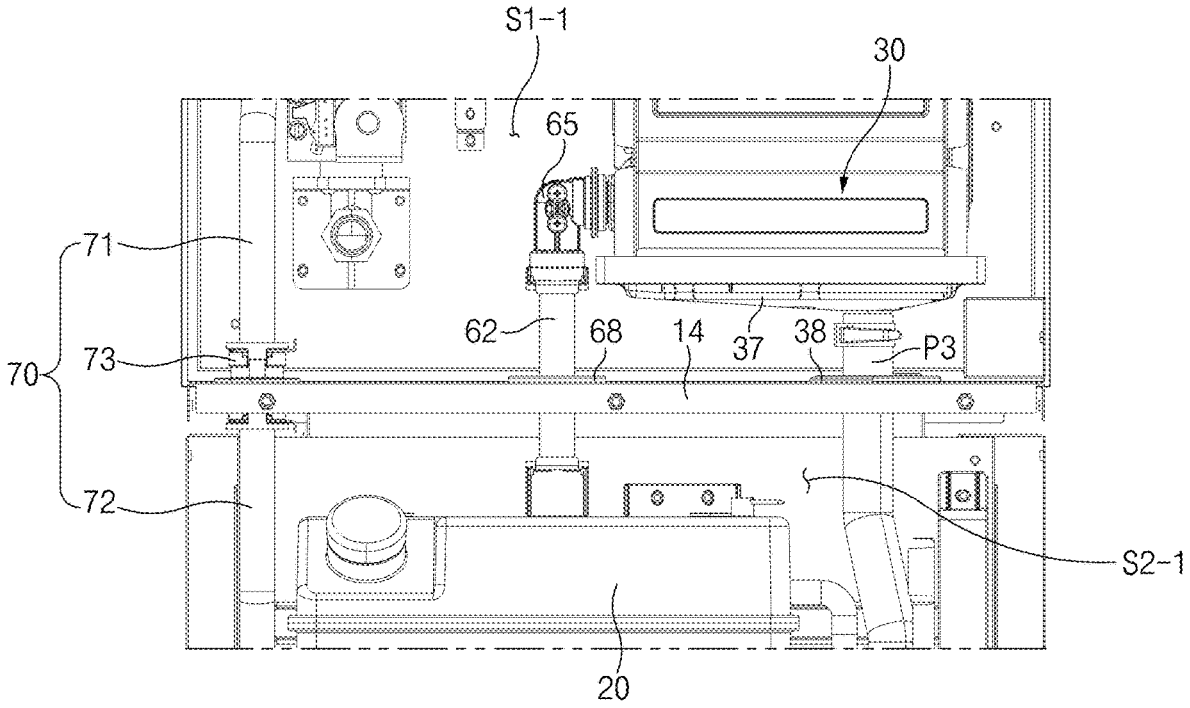
FIG. 11 is an enlarged view illustrating a first partition wall, when viewed in a reference direction.

FIG. 6 is an enlarged view illustrating a state, in which the second partition wall and a heating heat exchanger are separated from each other. FIG. 7 is an enlarged view illustrating a state, in which the second partition wall and the heating heat exchanger are separated from each other. FIG. 8 is a view illustrating a state, in which the second partition wall is separated from an outer box. FIG. 9 is a view illustrating a state, in which the heating heat exchanger is separated from an outer box. FIG. 10 is a view illustrating a lower side of the (1-1)-th division space and an enlarged view of the lower side thereof. FIG. 11 is an enlarged view illustrating the first partition wall, when viewed in a reference direction. For reference, some configurations, such as the outer box, may be omitted in the illustrations of the drawings for convenience of illustration.

<Structure for Separating Second Partition Wall 15>

Hereinafter, a structure for separating the second partition wall 15 will be described in detail. The second partition wall 15 may be coupled to the heating heat exchanger 40 in the reference direction "D" to be separable. Furthermore, the water heater 30 may be connected to the second partition wall 15 in the reference direction "D", and may be separated together with the second partition wall 15 when the second partition wall 15 is separated from the outer box 11.

As an example, a through-hole 15' may be formed in the second partition wall 15. The through-hole 15' may pass along the reference direction "D". A pair of through-holes 15' may be formed. Here, the expression of a pair does not always mean that the two through-holes 15' have corresponding shapes or locations.

The heating heat exchanger 40 may include a through-member 46. A portion of the through-member 46 may pass through the through-hole 15'. The through-member 46 may include a through-area 46' and a support area 46". The through-area 46' may extend in the reference direction "D" and may pass through the through-hole 15'. The support area 46" may be formed in an opposite direction to the reference direction of the through-area 46'. When a periphery of the support area 46" is viewed along the reference direction "D", a periphery of the through-hole 15' may be disposed on an inside thereof. This may mean that the through-member 46 is stopped by the support area 46" not to be moved even when the through-member 46 is moved in the reference direction "D". The second partition wall 15 may be screw-coupled to the support area 46". However, the coupling scheme is not limited to the screw-coupling scheme, but various modification, for example, by using an adhesive or magnets, may be made.

The support area 46" may include an impact absorbing part and a rigid part. The impact absorbing part may be a part, a volume of which is changed as it contacts the second partition wall 15 when the through-member 46 is moved in the reference direction "D". As an example, the impact absorbing part may be formed of expandable urethane foam. However, the present disclosure is not limited thereto, and various modifications may be made within a range, in which the volume may be changed. The impact absorbing part may function to maintain a sealing state of the through-hole 15' while being pressed such that the volume is decreased.

The rigid part may be coupled to the impact absorbing part in an opposite direction to the reference direction "D" to support the impact absorbing part in the opposite direction to the reference direction "D" of the impact absorbing part. The rigid part may be formed of a metallic material.

Meanwhile, the through-member 46 may include an introduction through-member **46*a* and a discharge through-member 46*b*. The introduction through-member 46*a* may pass through any one of the pair of through-holes 15' and may be connected to the main passage 60. Furthermore, the introduction through-member 46*a* may be connected to the distribution delivery pipe 441**.

The discharge through-member **46*b* may pass through the other one of the pair of through-holes 15' and may be connected to the recovery passage 70. The discharge through-member 46*b* may be connected to the collection delivery pipe 451**.

When the second partition wall 15 is separated, the heating heat exchanger 40 that is covered by the second partition wall 15 is exposed. The user may move the heating heat exchanger 40 exposed for repair of the heating heat exchanger 40 along the reference direction "D".

As an example, a first sliding groove that extends along the reference direction "D" may be formed at a portion of the outer box 11, which is adjacent to the (1-2)-th division space S1-2. The heating heat exchanger 40 may include a first sliding part 47 (FIG. 9) that is inserted into the first sliding groove along the reference direction "D" to be slid. Through the engagement structure, the heating heat exchanger 40 may be slid along the reference direction "D" after the second partition wall 15 is separated from the outer box 11 and may be separated from the outer box 11.

Meanwhile, to separate the second partition wall 15, the main passage 60, the recovery passage 70, and the condensate discharge pipe P3, which pass through the first partition wall 14, have to be separated. Hereinafter, a structure for separating the main passage 60, the recovery passage 70, and the condensate discharge pipe P3 will be sequentially described in detail.

The main passage 60 may include a first adapter 65. The first adapter 65 may be an adapter that connects an upper end of the second part 62 and the water heater 30. To separate the second partition wall 15, the first adapter 65 and the upper end of the second part 62 may be separated from each other.

The recovery passage 70 may include an upper part 71, a lower part 72, and a second adapter 73. The upper part 71 may mean a part located on an upper side of the first partition wall 14. The lower part 72 may mean a part located on a lower side of the first partition wall 14. The second adapter 73 may be an adapter that passes through the first partition wall 14 and connects the upper part 71 and the lower part 72. To separate the second partition wall 15, the second adapter 73 and the upper part 71 may be separated from each other.

The condensate discharge pipe P3 may be separated from the condensate receiver 37 to separate the second partition wall 15.

Meanwhile, to separate the second partition wall 15, the water left in the main passage 60, the recovery passage 70, and the condensate discharge pipe P3 has to be discharged. Hereinafter, a structure for discharging the water in the main passage 60, the recovery passage 70, and the condensate discharge pipe P3 will be sequentially described in detail.

The main passage 60 may include a water discharge part 66 and a water discharge valve 67. The water discharge part 66 may be connected to a lower side of the first part 61. The water discharge part 66 may be disposed on a lower side of a connection point of the first part 61 and the recovery passage 70.

The water discharge part 66 may extend perpendicularly to the first part 61, but the present disclosure is not limited thereto, and the water discharge part 66 also may extend in parallel to the first part 61 or in a direction that crosses an extension direction of the first part 61. Through the discharge part, the first part 61 and an outside of the first part 61 may be communicated with each other. The outside of the first part 61 may be an interior space of the case 10, and may be an outside of the case 10.

The water discharge valve 67 may be configured to open and close the water discharge part 66. When the water discharge valve 67 opens the water discharge part 66, all of the water in the expansion tank 20, the water in the main passage 60, and the water in the recovery passage 70 may be discharged through the water discharge part 66. The water discharge valve 67 may be a ball valve.

The water then may be directly discharged through the water discharge part 66, and may be discharged by connecting a separate hose to the water discharge part 66.

Unlike the main passage 60 and the recovery passage 70, the condensate discharge pipe P3 is not always filled with the water, and thus it may not be necessary to discharge the water from the condensate discharge pipe P3. When the condensate discharge pipe P3 is separated from the condensate receiver 37 even though it is necessary to discharge the water, the condensate may be discharged through an inclined surface of the condensate receiver 37.

<Method for Separating Second Partition Wall 15>

Hereinafter, a method for separating the second partition wall 15 will be described in detail with reference to the above-described contents. The method for separating the second partition wall may be one of methods for disassembling the air heating apparatus 1.

The method for disassembling the air heating apparatus may include a cover separating operation, a passage water discharging operation, and a second partition wall separating operation. The cover separating operation may be an operation of separating the first opening cover 13 of the case 10 of the air heating apparatus 1. The passage water discharging operation may be an operation of discharging the water in the main passage 60 and the recovery passage 70. The operation of separating the second partition wall 15 may be an operation of separating the second partition wall 15, to which the water heater 30 is coupled, from the outer box 11 of the case 10.

In the cover separating operation, the first opening cover 13 may be separated. As the first opening cover 13 is separated, the first opening 12 is opened, and the water heater 30 and the second partition wall 15 are exposed when viewed from the reference direction "D". Then, if necessary, the second opening cover 19 may be separated together.

The passage water discharging operation may include a water discharge part (66) opening operation of opening the water discharge part 66 by operating the water discharge valve 67, and a passage water draining operation of draining the water in the main passage 60 and the water in the recovery passage 70 through the water discharge part 66. When the water discharge valve 67 is opened, all of the water in the expansion tank 20, the water in the main passage 60, and the water in the recovery passage 70 may be discharged through the water discharge part 66.

The second partition wall separating operation may be an operation of separating the second partition wall 15 from the outer box 11. To separate the second partition wall 15, the first adapter 65 may be separated from the upper end of the second part 62. Furthermore, the second adapter 73 may be separated from the upper part 71. Furthermore, the condensate discharge pipe P3 may be separated from the condensate receiver 37. Furthermore, the main passage 60 may be separated from the introduction through-member 46*a*. Furthermore, the recovery passage may be separated from the discharge through-member 46*b*. Furthermore, the second partition wall 15 may be separated from the support area 46". Furthermore, opposite ends of the second partition wall 15 may be separated from the second contact area 17*b*. After the above-described separation, the second partition wall 15 may be pulled along the reference direction "D" and may be separated from the outer box 11.

As the second partition wall 15 is easily separated, the water heater 30 may be conveniently repaired, and may be easily reassembled after the repair. Furthermore, when the second partition wall 15 is separated, the heating heat exchanger 40 is exposed, the heating heat exchanger 40 may be easily repaired, or may be slid along the reference direction and may be separated for a repair. When coupling, such as screw-coupling, is present between the heating heat exchanger 40 and the outer box 11 before the separation, the coupling may be released in advance.

<Structure for Separating Third Partition Wall 16>

Hereinafter, a structure for separating the third partition wall 16 will be described in detail. The third partition wall 16 may be coupled to a portion of the outer box 11, which is located in the reference direction "D" of the fan 50, to be separable.

Figure 12:
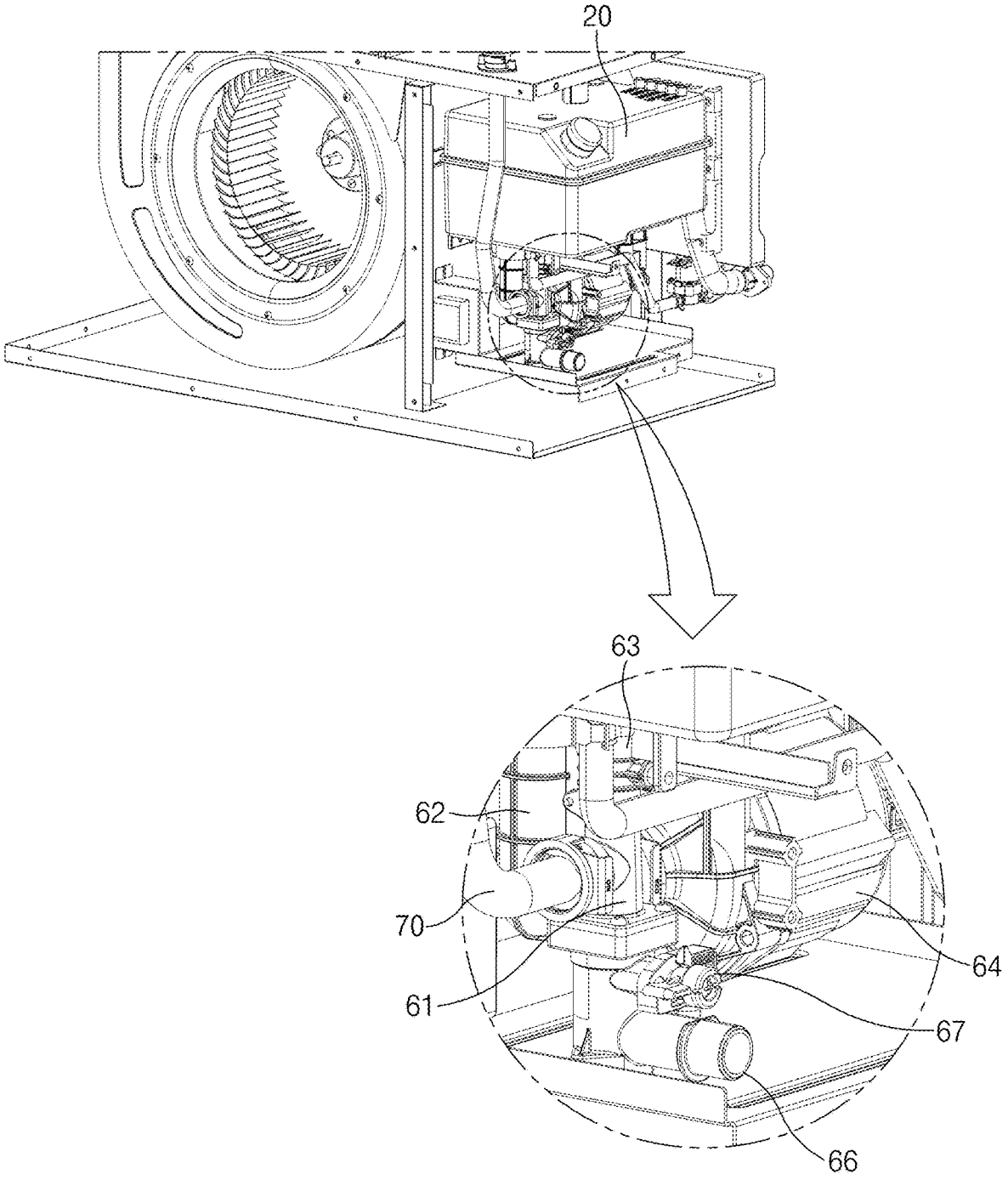
FIG. 12 is an enlarged view illustrating a lower side of a (2-1)-th division space.
Figure 13:
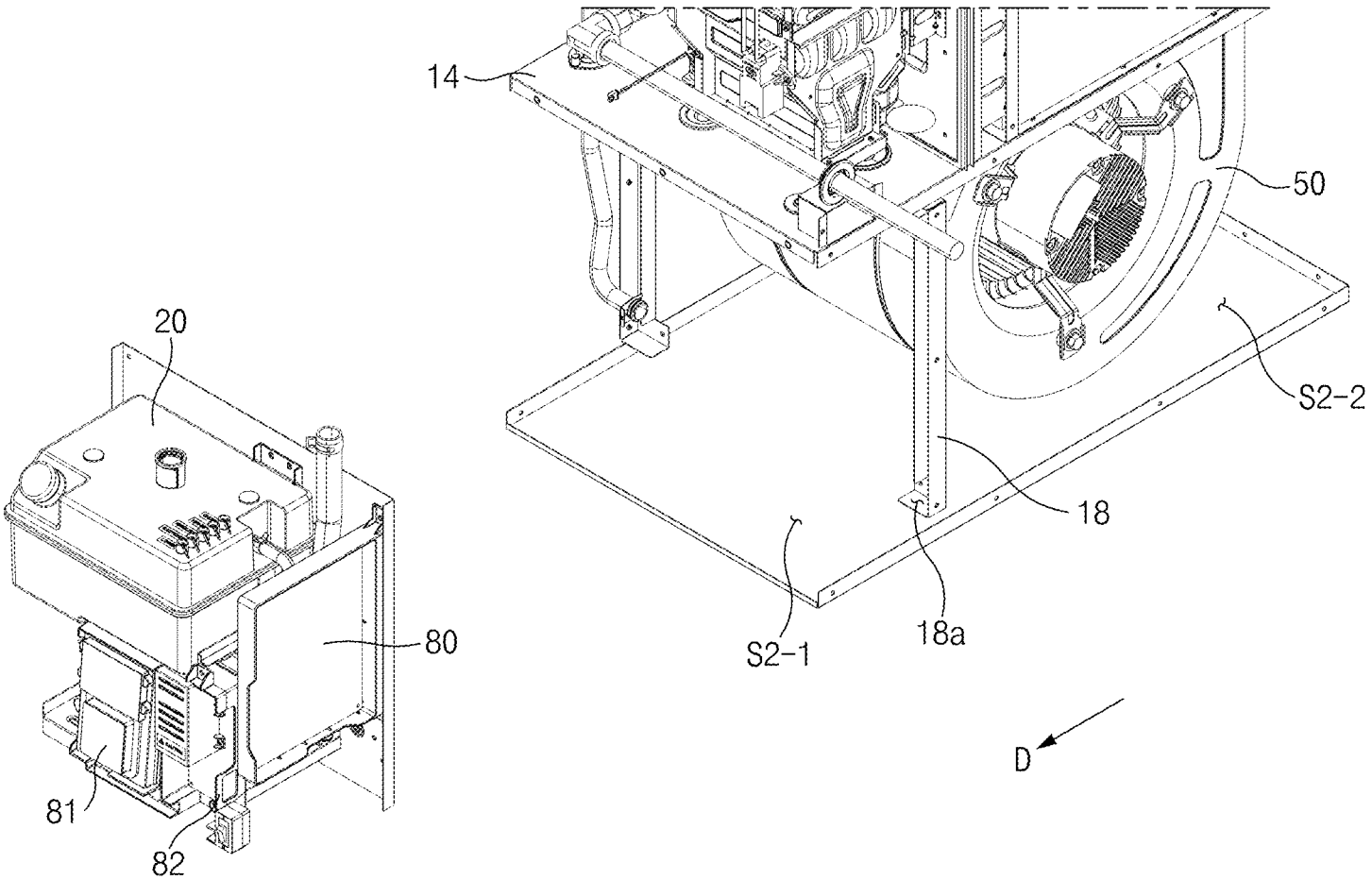
FIG. 13 is a view illustrating a state, in which a third partition wall is separated from an outer box.
Figure 14:
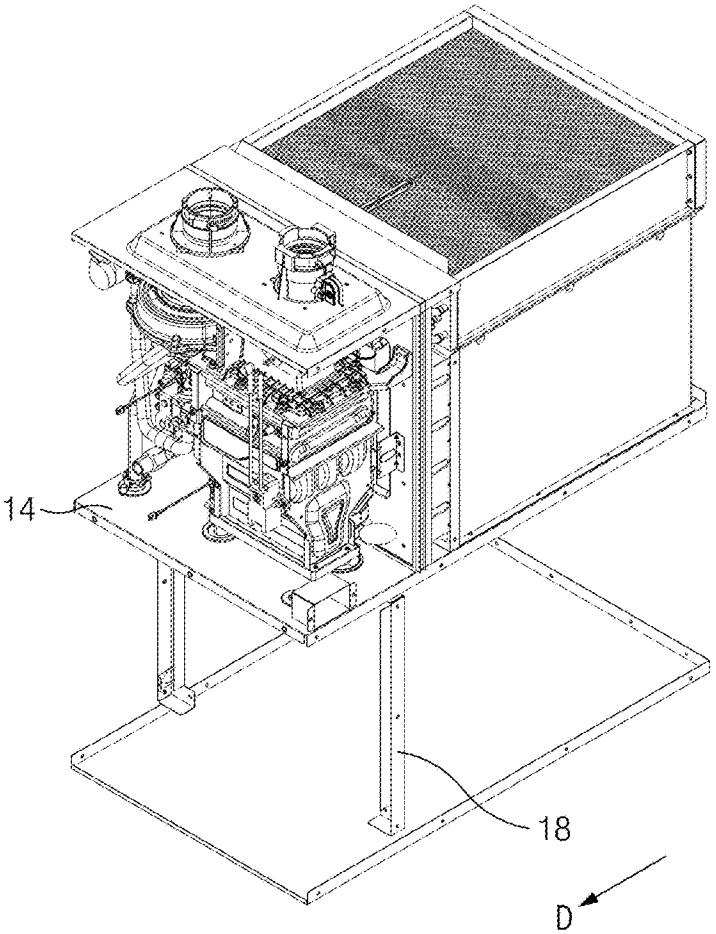
FIG. 14 is a view illustrating a state, in which a fan is separated from an outer box.
Figure 14:
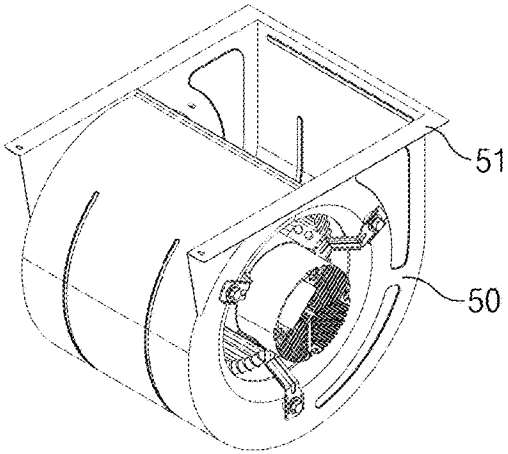

FIG. 12 is an enlarged view illustrating a lower side of the (2-1)-th division space. FIG. 13 is a view illustrating a state, in which the third partition wall is separated from an outer box. FIG. 14 is a view illustrating a state, in which the fan is separated from the outer box. For reference, some configurations, such as the outer box and the controller, may be omitted in the illustrations of the drawings for convenience of description.

The expansion tank 20 may be connected to the third partition wall 16 in the reference direction "D". Meanwhile, parts including a harness for electrical connection of the condensate trap "T", the controller 80, the manipulation part 81, the external interworking controller 82, and the controller 80, which have been described above, including the expansion tank 20, may be coupled together to the third partition wall 16. For convenience of description, the above-described parts, including the expansion tank 20, will be referred to as water modules. The water modules may be separated together with the third partition wall 16 when the third partition wall 16 is separated from the outer box 11 as illustrated in FIG. 12.

When the third partition wall 16 is separated, the fan 50 that is covered by the third partition wall 16 is exposed. The user may move the fan 50 exposed for a repair of the fan 50 along the reference direction "D".

As an example, a second sliding groove that extends along the reference direction "D" may be formed at a portion of the outer box 11, which is adjacent to the (2-2)-th division space S2-2. The fan 50 may include a second sliding part 51 that is inserted into the second sliding groove along the reference direction "D" to be slid. Through the engagement structure, the fan 50 may be slid along the reference direction "D" after the third partition wall 16 is separated from the outer box 11 and may be separated from the outer box 11.

Meanwhile, to separate the third partition wall 16, the main passage 60, the recovery passage 70, and the condensate discharge pipe P3, which pass through the first partition wall 14, have to be separated. The main passage 60 may be separated through the separation of the second part 62 and the first adapter 65, which have been described above. Furthermore, the recovery passage 70 may be separated through separation of the second adapter 73 and the lower part 72. Furthermore, the condensate discharge pipe P3 may be separated through the separation of the condensate receiver 37 and the condensate discharge pipe P3, which have been described above.

Meanwhile, to separate the third partition wall 16, the water left in the expansion tank 20, the main passage 60, and the recovery passage 70 have to be discharged. Hereinafter, a structure for discharging the water in the expansion tank 20, the main passage 60, and the recovery passage 70 will be described in detail. The condensate discharge pipe P3 has been described, and thus a description thereof will be omitted.

As described above, the main passage 60 may include the water discharge part 66 and the water discharge valve 67. Because the expansion tank 20 is connected to the main passage 60, the water in the expansion tank 20 and the water in the main passage 60 may be discharged together.

When the water discharge valve 67 opens the water discharge part 66, all of the water in the expansion tank 20, the water in the main passage 60, and the water in the recovery passage 70 may be discharged through the water discharge part 66.

The water then may be directly discharged through the water discharge part 66, or may be discharged by connecting a separate hose to the water discharge part 66.

<Method for Separating Third Partition Wall 16>

Hereinafter, a method for separating the third partition wall 16 will be described in detail with reference to the above-described contents. The method for separating the third partition wall may be one of methods for disassembling the air heating apparatus 1.

The method for disassembling the air heating apparatus may include a cover separating operation, a tank water discharging operation, and a third partition wall separating operation. The cover separating operation may be an operation of separating the first opening cover 13 of the case 10 of the air heating apparatus 1. The tank water discharging operation may be an operation of discharging the water in the expansion tank 20 of the air heating apparatus 1. In the tank water discharging operation, the water in the main passage 60 and the recovery passage 70 also may be discharged together. The operation of separating the third partition wall 16 may be an operation of separating the third partition wall 16, to which the expansion tank 20 is coupled, from the outer box 11 of the case 10.

In the cover separating operation, the first opening cover 13 may be separated. As the first opening cover 13 is separated, the first opening 12 is opened, and the expansion tank 20 and the second partition wall 15 are exposed when viewed from the reference direction "D".

The tank water discharging operation may include a water discharge part (66) opening operation of opening the water discharge part 66 by operating the water discharge valve 67, and a tank water draining operation of draining the water in the expansion tank 20 through the water discharge part 66. When the water discharge valve 67 is opened, all of the water in the expansion tank 20, the water in the main passage 60, and the water in the recovery passage 70 may be discharged through the water discharge part 66.

The third partition wall separating operation may be an operation of separating the third partition wall 16 from the outer box 11. To separate the third partition wall 16, the first adapter 65 may be separated from the upper end of the second part 62. Furthermore, the second adapter 73 may be separated from the lower part 72. Furthermore, the condensate discharge pipe P3 may be separated from the condensate receiver 37. Furthermore, the third partition wall 16 may be separated from the guide part 18. After the above-described separation, the third partition wall 16 may be pulled along the reference direction "D" and may be separated from the outer box 11.

<Structure for Changing Disposition>

Furthermore, according to the air heating apparatus 1 according to the first embodiment of the present disclosure, the disposition thereof may be freely changed. The free disposition may mean that locations of configurations that protrude to an outside or the case 10 may be changed.

Hereinafter, a structure for changing the location of the configurations that protrude to the outside of the case 10 will be described below. The configurations that protrudes to the outside may include the fuel introducing pipe P2, the water introducing pipe P1, and the condensate discharge pipe P3.

Figure 15:
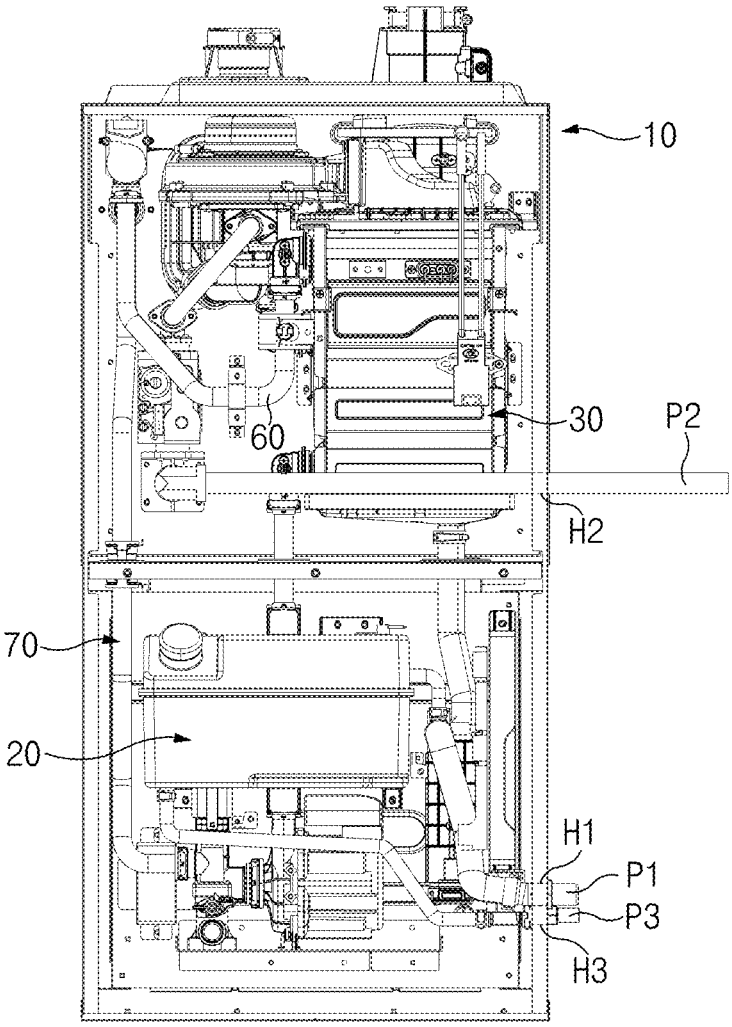
FIG. 15 is a view illustrating that a water introducing pipe, a fuel introducing pipe, and a condensate discharge pipe are disposed in an opposite way to disposition of FIG. 3.

FIG. 15 is a view illustrating that the water introducing pipe, the fuel introducing pipe, and the condensate discharge pipe are disposed in an opposite way to the disposition of FIG. 3.

One introduction hole H1 may be formed in each of opposite side walls of the case 10, which are perpendicular to the upward/downward direction and the reference direction "D". The water introducing pipe P1 may pass through any one of the pair of introduction holes H1 of the case 10. The other introduction hole H1, through which the water introducing pipe P1 does not pass, may be covered by a plug.

One fuel introduction hole H2 may be formed in each of opposite side walls of the case 10, which are perpendicular to the upward/downward direction and the reference direction "D". The fuel introducing pipe P2 may pass through any one of the pair of fuel introducing holes H2 of the case 10. The other fuel introducing hole H2, through which the fuel introducing pipe P2 does not pass, may be covered by a plug.

Furthermore, one condensate discharge hole H3 may be formed in each of opposite side walls of the case 10, which are perpendicular to the upward/downward direction and the reference direction "D". When the reference direction "D" is a forward direction, the opposite side walls may be left and right side walls. The condensate discharge pipe P3 may pass through any one of the pair of condensate discharge holes H3. The other condensate discharge hole H3, through which the condensate discharge pipe P3 does not pass, may be covered by a plug.

As an example, when a wall is located on a left side of the case 10, it may be inconvenient for disposition when the condensate discharge pipe P3, the water introducing pipe P1, and the fuel introducing pipe P2 are formed on the left side. In this case, the condensate discharge pipe P3, the water introducing pipe P1, and the fuel introducing pipe P2 may pass through the condensate discharge hole H3, the introduction hole H1, and the fuel introducing hole H2 located on the right side. Furthermore, when the case 10 is moved into a case, in which a wall is located on the right side of the case 10 later, the condensate discharge pipe P3, the water introducing pipe P1, and the fuel introducing pipe P2 may be moved in an opposite way. This may be understood that the state of FIG. 3 is changed to the state of FIG. 15 or an opposite state thereto.

<Water Supplementing Structure>

According to the air heating apparatus 1 according to the first embodiment of the present disclosure, the water may be supplemented to the expansion tank 20 while the first opening cover 13 is not separated. Hereinafter, a structure having the effect will be described in detail.

Figure 16:
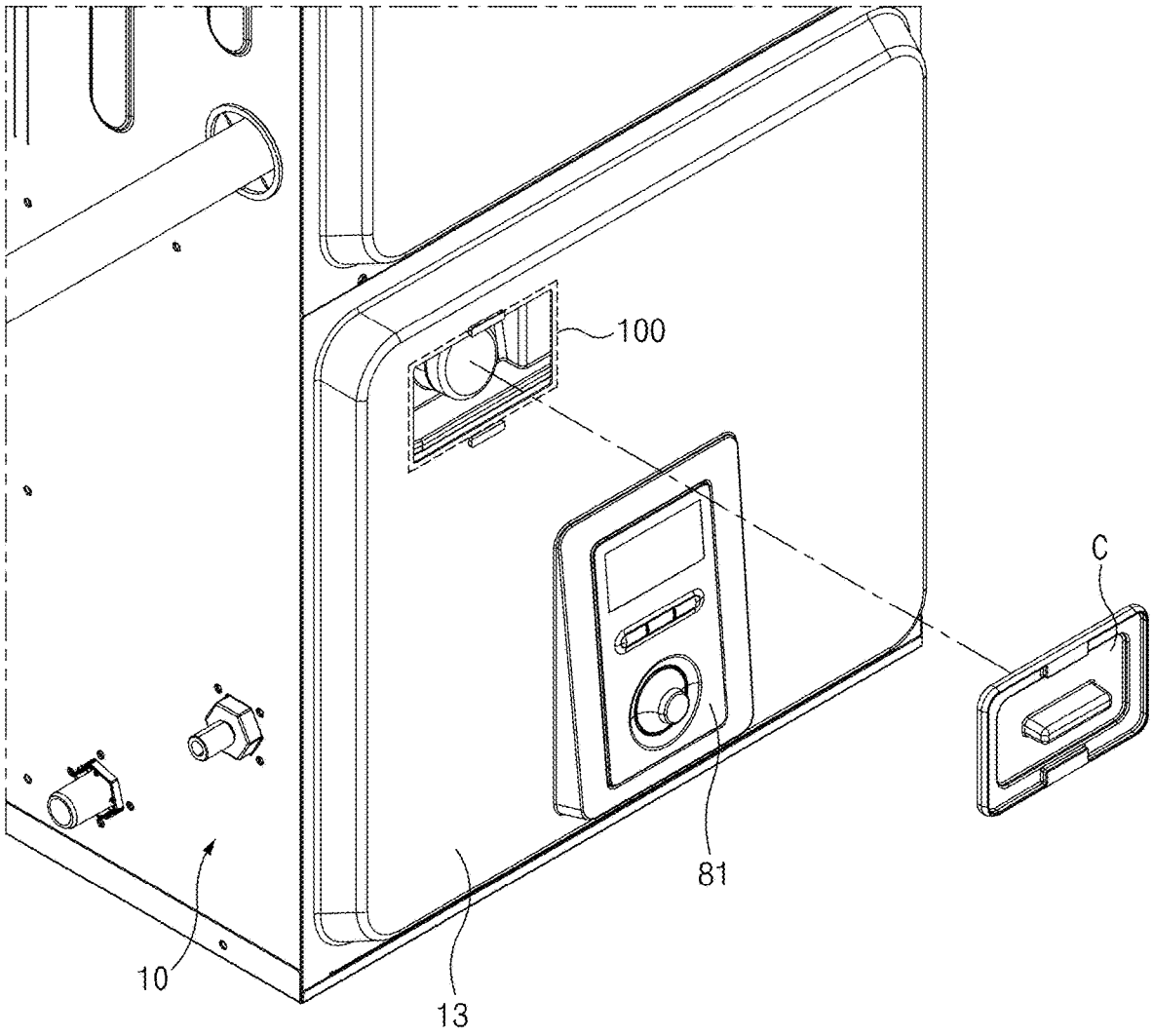
FIG. 16 is a view illustrating a state, in which a cover is removed.
Figure 17:
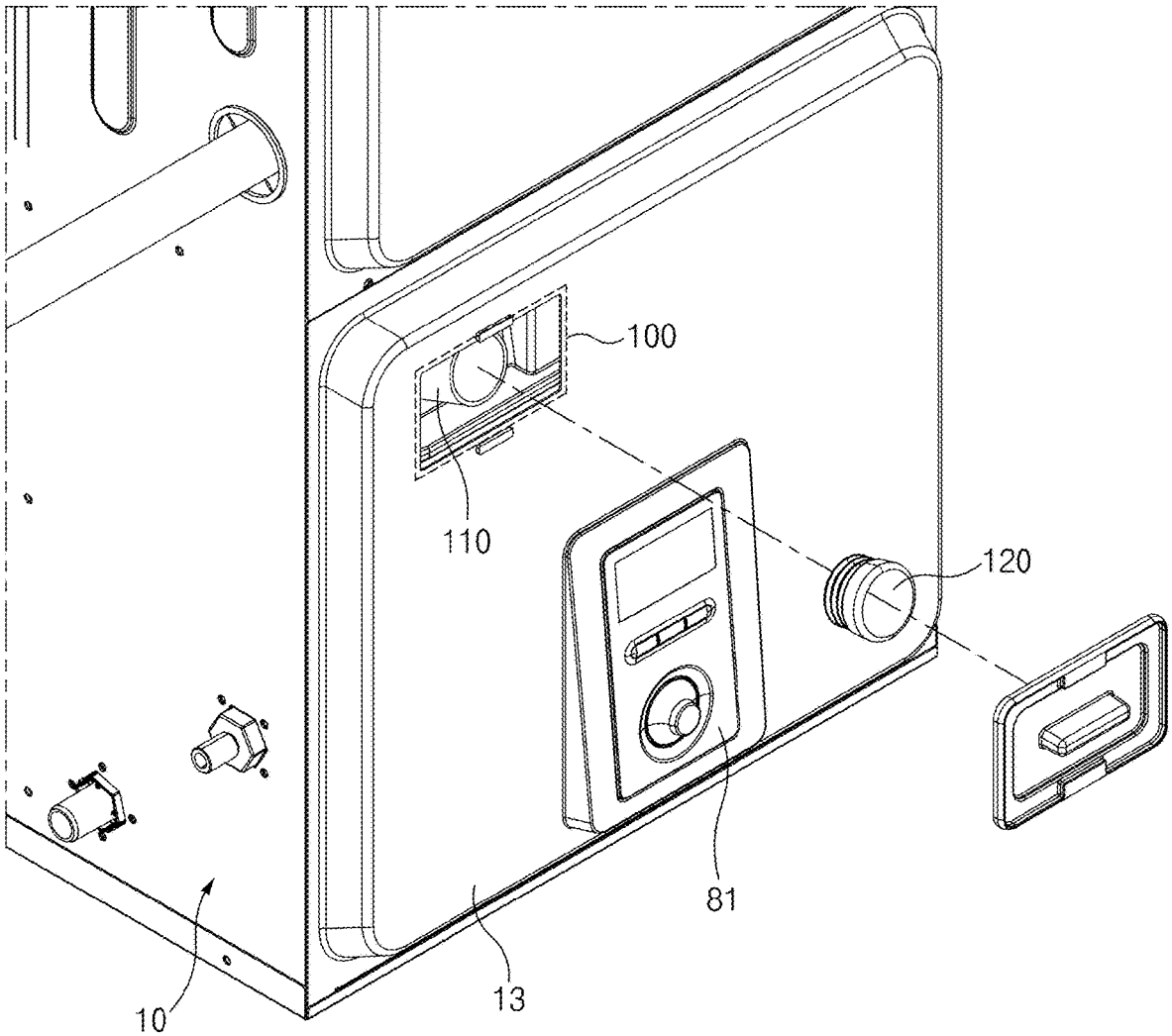
FIG. 17 is a view illustrating a state, in which an opening/closing member is separated.
Figure 18:
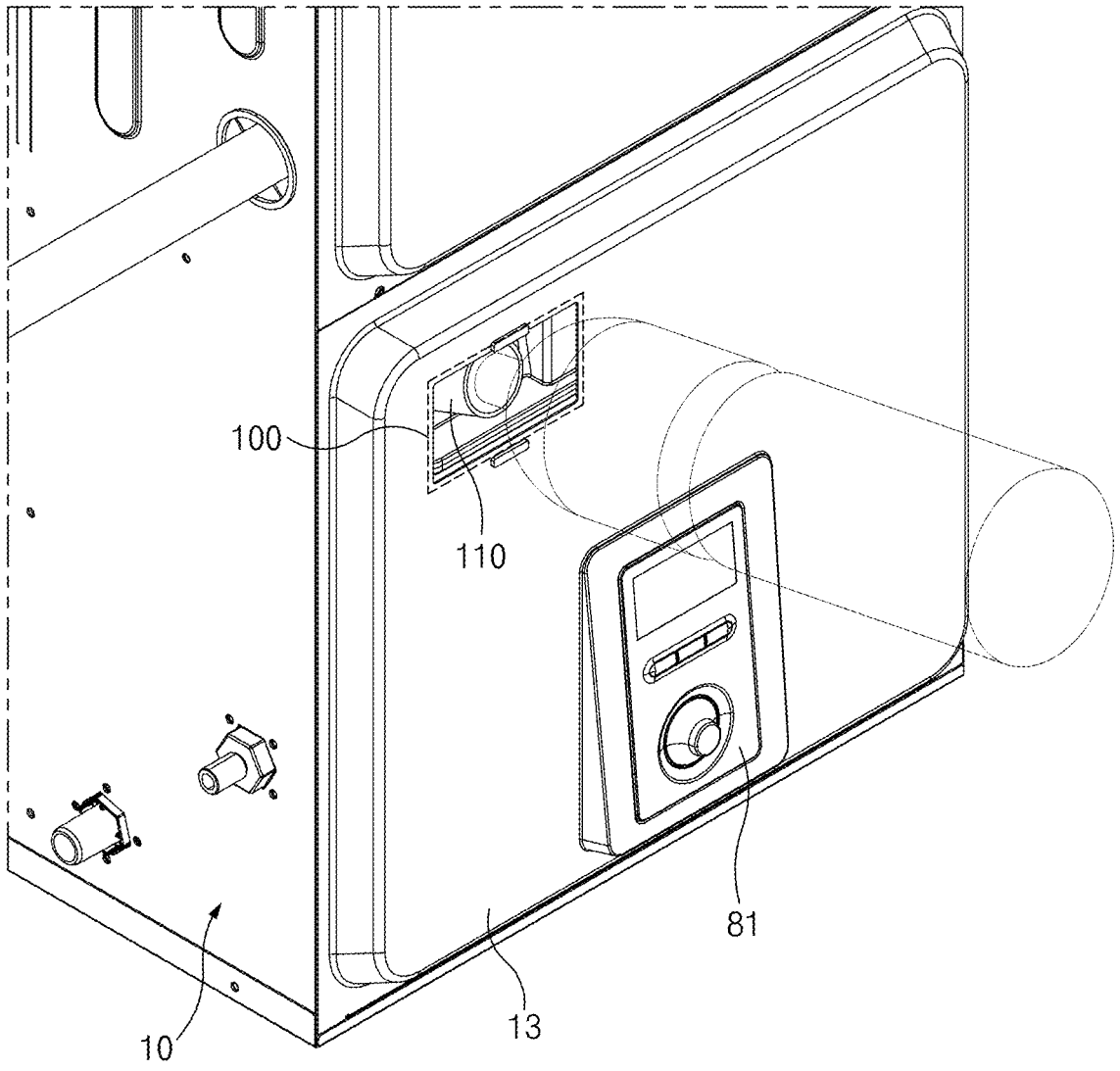
FIG. 18 is a view illustrating a state, in which water is introduced into an expansion tank through a communication part.

FIG. 16 is a view illustrating a state, in which the cover is removed. FIG. 17 is a view illustrating a state, in which an opening/closing member is separated. FIG. 18 is a view illustrating a state, in which water is introduced into the expansion tank through a communication part.

A communication part 100 may be formed in the first opening cover 13. However, the present disclosure is not limited thereto, and the communication part 100 may be formed in the outer box 11. The communication part 100 may be opened such that the water is guided from an outside to the expansion tank 20 by connecting the expansion tank 20 and the outside.

A communication member 110 and an opening/closing member 120 may be disposed in the communication part 100. The communication member 110 may be a configuration for injecting exterior water into the expansion tank 20 by connecting the expansion tank 20 and the outside such that the expansion tank 20 and the outside may be communicated with each other. To achieve this, one end of the communication member 110 may be connected to the expansion tank 20. The opening/closing member 120 may be configured to open and close a distal end of the communication member 110, which is located on the outside. As an example, the opening/closing member 120 may have a shape of a lid used for general beverages.

An overflow pipe for discharging the water overflowing from the expansion tank 20 may be connected to the expansion tank 20. The overflow pipe may be connected to the expansion tank 20 on a lower side of a location, at which the communication member 110 and the expansion tank 20 are connected to each other. Accordingly, when an amount of water that is more than necessary is injected into the expansion tank 20, it may be discharged through the overflow pipe.

Meanwhile, the communication part 100, the communication member 110, and the opening/closing member 120 may be variously modified in a range, in which the exterior water may be introduced into the expansion tank 20.

As an example, the opened communication part 100 may be formed in the first opening cover 13. In this case, with respect to the reference direction "D", the communication member 110 may not protrude from the first opening cover 13. In this case, a separate cover "C" that covers the communication part 100 may be formed.

Figure 19:
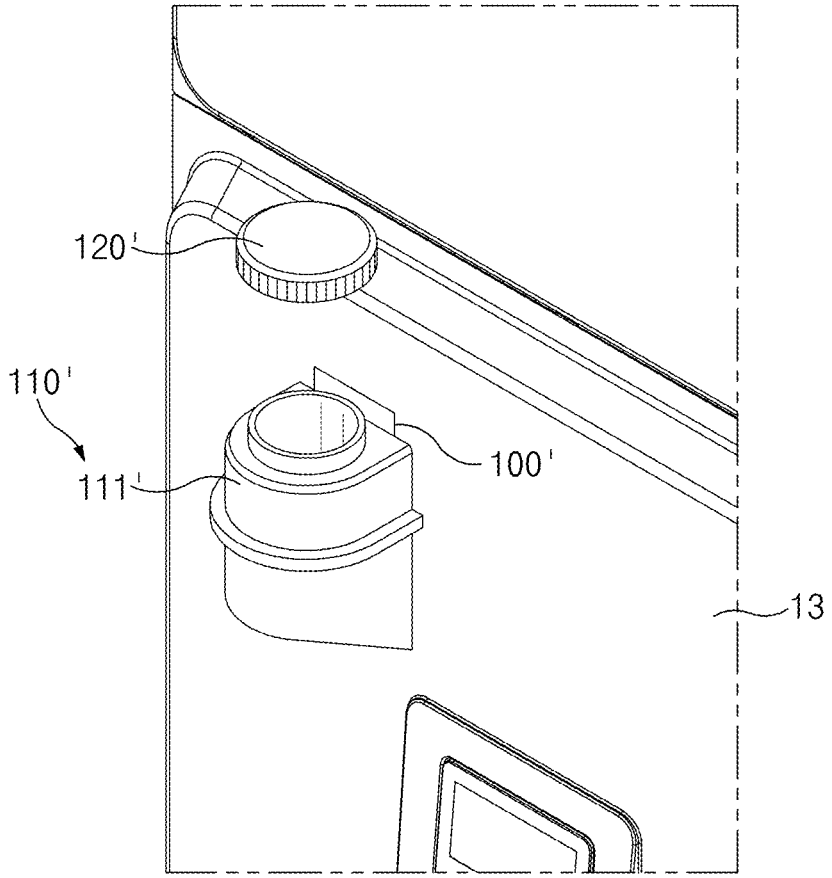
FIG. 19 is a view illustrating another example of a communication part.
Figure 20:
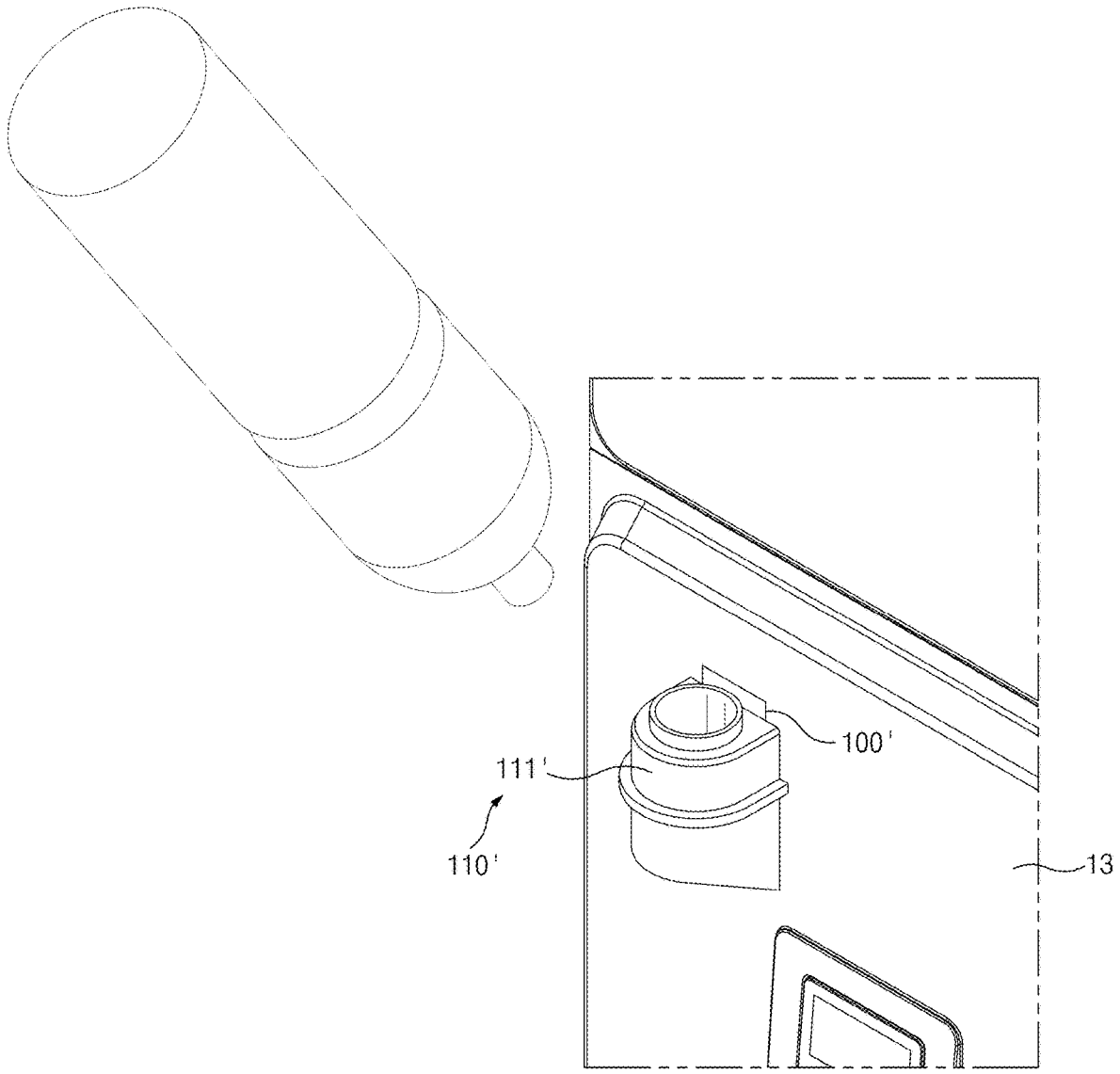
FIG. 20 is a view illustrating a state, in which water is introduced into an expansion tank through another example of a communication part.

As another example, the communication part 100 may be opened, and a communication member 100' may pass through the communication part 100. The communication member 110' may include an outward protruding area 111' that is an area that protrudes to the outside of the case 10. FIG. 19 is a view illustrating another example of the communication part. FIG. 20 is a view illustrating a state, in which water is introduced into the expansion tank through another example of the communication part. In this case, the outward protruding area 111' may be opened upwards.

Meanwhile, an inclined area may be formed in the communication member 110' such that the water introduced into the communication member 110' flows into the expansion tank 20 without using a separate power source. The inclined area may have a shape that is inclined upwards when viewed from the expansion tank 20.

<Water Supply Method>

Hereinafter, a method for supplying water to the air heating apparatus, through which the water is supplied into the expansion tank 20 of the air heating apparatus 1 will be described in detail based on the above-described contents. In a description of the method for supplying water to the air heating apparatus, FIGS. 16 to 20 that have been described above will be referenced.

The method for supplying water to the air heating apparatus may include an opening operation and an injection operation. The opening operation may be an operation of opening the communication part 100 or 100' of the case 10 of the air heating apparatus 1. As an example, the opening operation may be an operation of opening a distal end of the communication member 110 or 110', which is located on an outside of the case 10, by separating the opening/closing member 120 or 120' from the communication member 110 or 110'. The injection operation may be an operation of injecting the water into the expansion tank 20 of the air heating apparatus 1 through the communication part 100 or 100'.

Meanwhile, a water level detecting sensor may be disposed in the expansion tank 20. A water level detected through the water level detecting sensor may be displayed on a display or the like of a measurement part 81. Furthermore, an alarm, such as a warning sound, for the user may be generated based on the water level acquired by the water level detecting sensor. As an example, when stages for the water level acquired by the water level detecting sensor are in a range of a first stage corresponding to a lowermost water level to a fifth stage corresponding to an uppermost water level, the controller 80 may generate an alarm for supplementing the water in a second stage to notify the user. In this case, the user may recognize a state, in which the water has to be supplemented, through the alarm, and may supplement the water.

According to the air heating apparatus according to the present disclosure, because the user may be notified of the water has to be supplemented before the water level reaches the lowermost stage, the equipment may be prevented from being stopped due to the water level.

Second Embodiment

Figure 21:
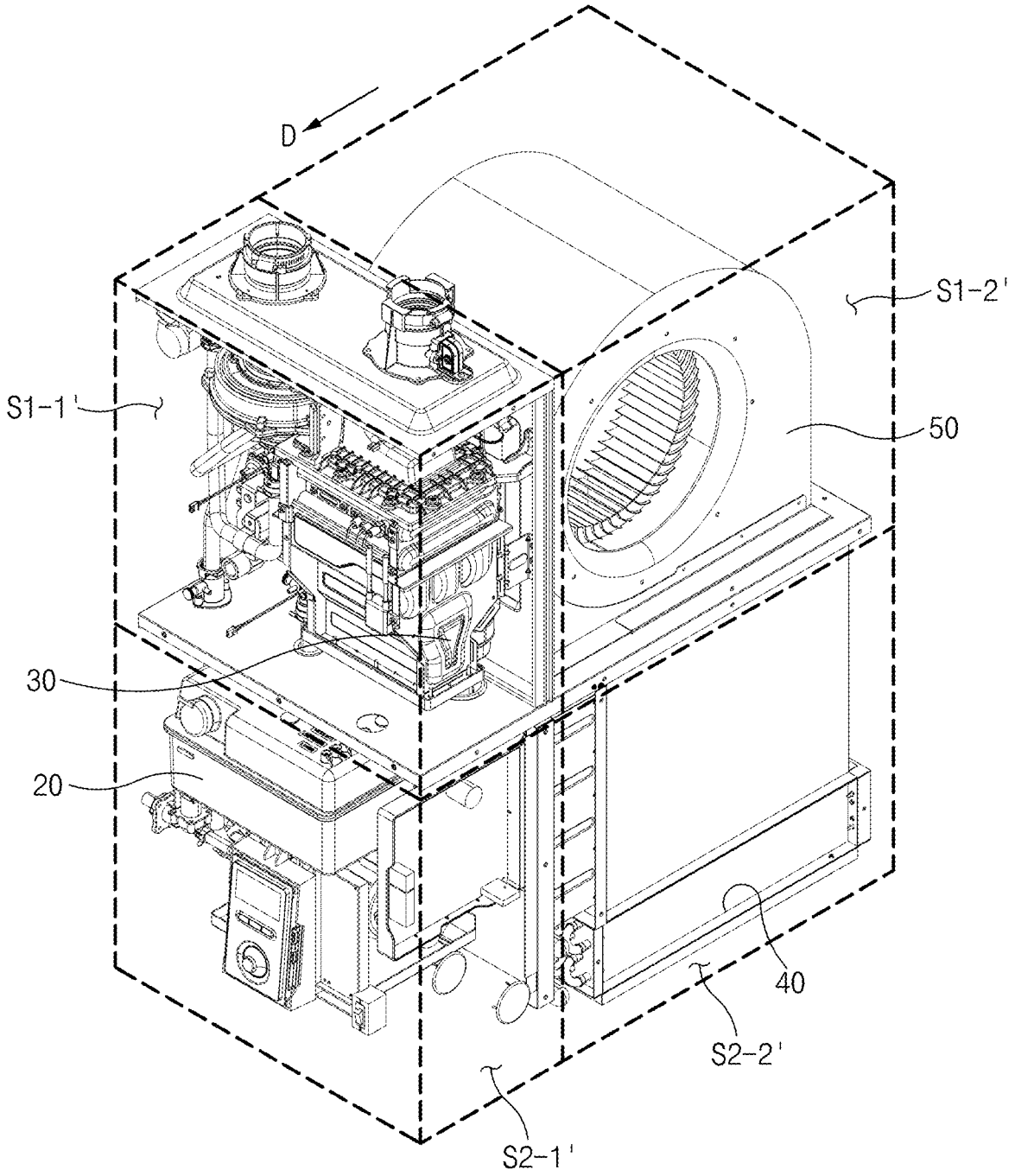
FIG. 21 is a view illustrating an air heating apparatus according to a second embodiment of the present disclosure, from which an outer box is removed.

FIG. 21 is a view illustrating an air heating apparatus according to a second embodiment of the present disclosure, from which an outer box is removed. Hereinafter, the air heating apparatus according to the second embodiment will be described in detail based on FIG. 21 and the above-described contents. The air heating apparatus according to the second embodiment is different from the air heating apparatus 1 according to the first embodiment in that the locations of the fan 50 and the heating heat exchanger 40 are changed. It will be understood that the air heating apparatus 1 according to the first embodiment is of an upflow scheme whereas the air heating apparatus according to the second embodiment is of a downflow scheme. The same or corresponding configurations to those of the air heating apparatus according to the first embodiment will be endowed with the same or corresponding reference numerals, and a detailed description thereof will be omitted.

The water heater 30 may be disposed in a (1-1)-th division space S1-1' of the air heating apparatus of the second embodiment. The fan 50 may be disposed in a (1-2)-th division space S1-2' of the air heating apparatus 1 according to the second embodiment. The expansion tank 20 may be disposed in a (2-1)-th division space S2-1' of the air heating apparatus of the second embodiment. The heating heat exchanger 40 may be disposed in a (2-2)-th division space S2-2' of the air heating apparatus of the second embodiment. The locations of the heating heat exchanger 40 and the fan 50 are changed, the shapes of the components, including the main passage 60 (FIG. 3) and the recovery passage 70 (FIG. 3) may be changed correspondingly.

Third Embodiment

Figure 22:
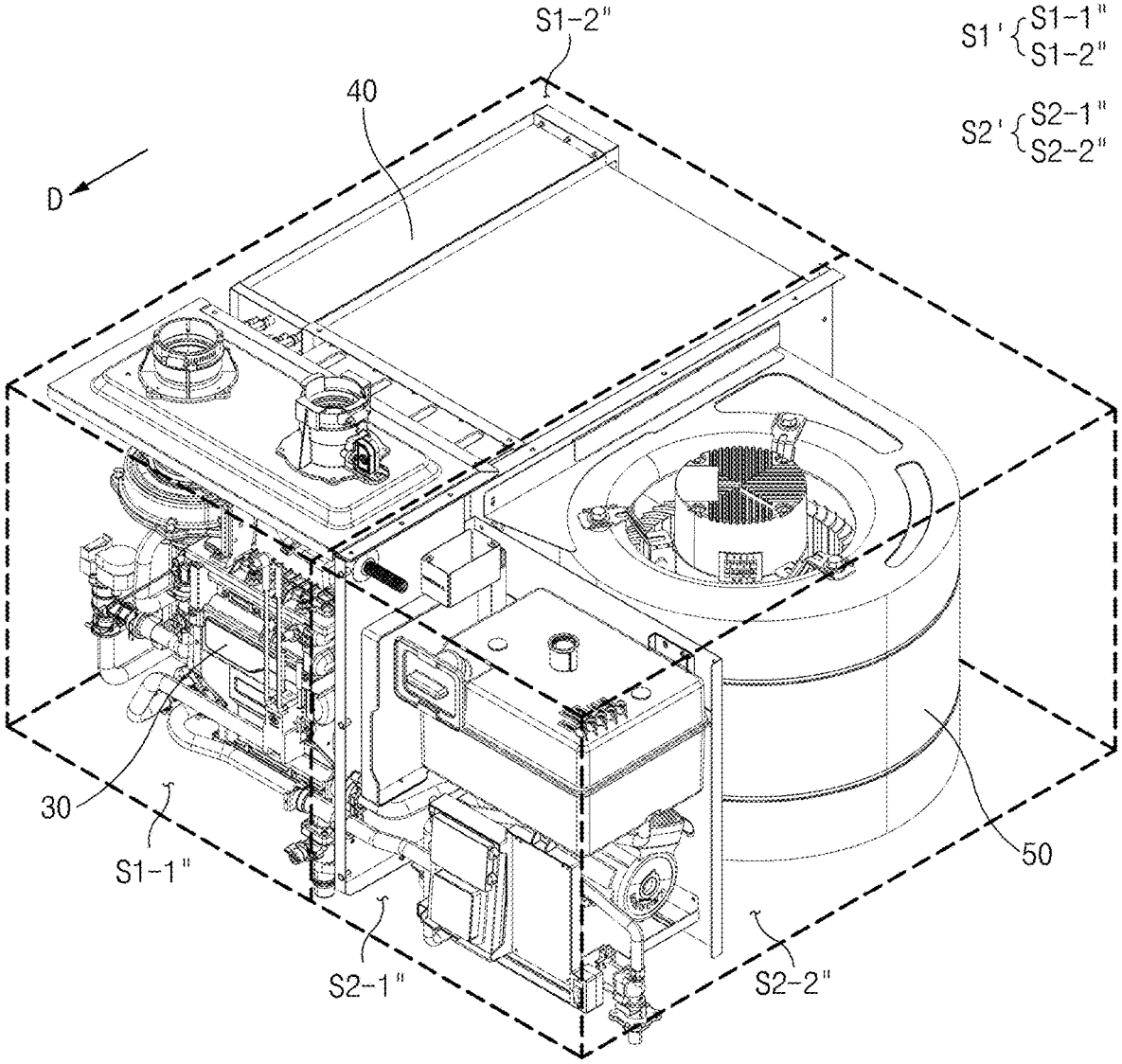
FIG. 22 is a view illustrating an air heating apparatus according to a third embodiment of the present disclosure, from which an outer box is removed.

FIG. 22 is a view illustrating an air heating apparatus according to a third embodiment of the present disclosure, from which an outer box is removed. Hereinafter, the air heating apparatus according to the third embodiment will be described in detail based on FIG. 22 and the above-described contents. The air heating apparatus according to the third embodiment is different from the air heating apparatus 1 according to the first embodiment in that the first division space is disposed on a lateral side of the second division space. The same or corresponding configurations to those of the air heating apparatus according to the first embodiment will be endowed with the same or corresponding reference numerals, and a detailed description thereof will be omitted.

A first division space S1' may be disposed in a direction that is perpendicular to the upward/downward direction and the reference direction "D" of a second division space S2'. When the reference direction "D" is a forward direction, the first division space S1' may be disposed on any one of the left and right sides of the second division space S2'. The water heater 30 may be disposed in a (1-1)-th division space S1-1" of the air heating apparatus of the third embodiment. Any one of the heating heat exchanger 40 and the fan 50 may be disposed in a (1-2)-th division space S1-2" of the air heating apparatus according to the third embodiment. The expansion tank 20 may be disposed in a (2-1)-th division space S2-1" of the air heating apparatus of the third embodiment. Another one of the heating heat exchanger 40 and the fan 50 may be disposed in a (2-2)-th division space S2-2" of the air heating apparatus according to the third embodiment. Because an entire disposition of the water heater 30, the heating heat exchanger 40, the expansion tank 20, and the fan 50 is changed, the shapes of the other components, including the main passage 60 and the recovery passage 70, may be changed correspondingly.

As an example, unlike the air heating apparatus 1 of the first embodiment, in which the condensate is discharged through the condensate discharge pipe P3 that passes through the first partition wall 14 to pass through the (2-1)-th division space S2-1, the condensate may be discharged immediately below in the water heater 30 and may be discharged after passing through a separate trap located on the lower side of the water heater 30 in the air heating apparatus of the third embodiment.

According to the present disclosure, the parts may be formed into one module to be separable, and thus the internal parts thereof may be easily repaired.

The above description is a simple exemplification of the technical spirits of the present disclosure, and the present disclosure may be variously corrected and modified by those skilled in the art to which the present disclosure pertains without departing from the essential features of the present disclosure. Accordingly, the embodiments disclosed in the present disclosure is not provided to limit the technical spirits of the present disclosure but provided to describe the present disclosure, and the scope of the technical spirits of the present disclosure is not limited by the embodiments. Accordingly, the technical scope of the present disclosure should be construed by the attached claims, and all the technical spirits within the equivalent ranges fall within the scope of the present disclosure.

What is claimed is:

1. An air heating apparatus comprising:

an expansion tank configured to preserve water;

a water heater configured to receive heat from a combustion gas generated through a combustion reaction and heat the water;

a heating heat exchanger configured to receive the water heated by the water heater and exchange heat with air that is to be discharged for heating;

a fan configured to send the air to the heating heat exchanger; and a case, in which the water heater, the expansion tank, the heating heat exchanger, and the fan are disposed in an interior thereof, wherein the case includes:

an outer box having a first opening in a reference direction that is one direction that is perpendicular to an upward/downward direction;

a first opening cover coupled to the outer box and covering the first opening when being coupled to the outer box;

a first partition wall coupled to the outer box, and extending along the reference direction to divide an interior of the outer box to a first division space and a second division space;

a second partition wall disposed in the interior of the outer box to be perpendicular to the first partition wall to divide the first division space to a (1-1)-th division space and a (1-2)-th division space; and a third partition wall disposed in the interior of the outer box to be perpendicular to the first partition wall to divide the second division space to a (2-1)-th division space and a (2-2)-th division space, and wherein the second partition wall and the third partition wall may be separated from the interior of the outer box;

wherein the second partition wall is coupled to the interior of the outer box to be separable; and wherein the third partition wall is coupled to the interior of the outer box to be separable.

2. The air heating apparatus of claim 1, wherein the water heater is disposed in the (1-1)-th division space, wherein any one of the heating heat exchanger or the fan is disposed in the (1-2)-th division space, wherein the expansion tank is disposed in the (2-1)-th division space, and wherein the other one of the heating heat exchanger or the fan is disposed in the (2-2)-th division space.

3. The air heating apparatus of claim 2, wherein the first division space is disposed on an upper side of the second division space, wherein the heating heat exchanger is disposed in the (1-2)-th division space, and wherein the fan is disposed in the (2-2)-th division space.

4. The air heating apparatus of claim 2, wherein the first division space is disposed on an upper side of the second division space, wherein the fan is disposed in the (1-2)-th division space, and wherein the heating heat exchanger is disposed in the (2-2)-th division space.

5. The air heating apparatus of claim 2, wherein the first division space is disposed in a direction that is perpendicular to an upward/downward direction of the second division space and the reference direction.

6. The air heating apparatus of claim 2, wherein the water heater is connected to the second partition wall in the reference direction, and is separated together with the second partition wall when the second partition wall is separated from the outer box.

7. The air heating apparatus of claim 2, wherein the case further includes:

a contact part including:

a first contact area contacting an inner surface of the outer box and extending toward the reference direction; and a second contact area protruding from a distal end of the first contact area in the reference direction toward an inside of the outer box, and coupled to opposite ends of the second partition wall.

8. The air heating apparatus of claim 2, wherein the outer box has a guide part having a guide groove opened toward the reference direction such that opposite ends of the third partition wall are inserted thereinto, and wherein the opposite ends of the third partition wall protrudes toward the reference direction.

9. The air heating apparatus of claim 2, wherein the expansion tank is connected to the third partition wall in the reference direction, and is separated together with the third partition wall when the third partition wall is separated from the outer box.

10. The air heating apparatus of claim 3, wherein the second partition wall is coupled to the heating heat exchanger in the reference direction to be separable.

11. The air heating apparatus of claim 3, wherein a first sliding groove extending along the reference direction is formed at a portion of the outer box, which is adjacent to the (1-2)-th division space, and wherein the heating heat exchanger includes a first sliding part inserted into the first sliding groove along the reference direction to be slid, and is separated from the outer box as the second partition wall is slid along the reference direction after being separated from the outer box.

12. The air heating apparatus of claim 3, wherein the third partition wall is coupled to a portion of the outer box, which is located in the reference direction of the fan, to be separable.

13. The air heating apparatus of claim 3, wherein a second sliding groove extending along the reference direction is formed at a portion of the outer box, which is adjacent to the (2-2)-th division space, and wherein the fan includes a second sliding part inserted into the second sliding groove along the reference direction to be slid, and is separated from the outer box as the third partition wall is slid along the reference direction after being separated from the outer box.

14. The air heating apparatus of claim 1, wherein a length of the (1-1)-th division space along the upward/downward direction corresponds to a length of the (1-2)-th division space along the upward/downward direction, and wherein a length of the (2-1)-th division space along the upward/downward direction corresponds to a length of the (2-2)-th division space along the upward/downward direction.

15. The air heating apparatus of claim 1, wherein a second opening opened upwards is formed on an upper side of the outer box, and wherein the case further includes:

a second opening cover coupled to the outer box, and covering the second opening when being coupled to the outer box.

16. The air heating apparatus of claim 15, further comprising:

an air supply hole formed in the second opening cover and configured to supply exterior air to the water heater; and a gas discharge hole configured to discharge the combustion gas generated through the combustion reaction of the water heater, wherein the air supply hole and the gas discharge hole are formed in an area of the second opening cover, which protrudes upwards.

17. An air heating apparatus comprising:

an expansion tank configured to preserve water;

a water heater configured to receive heat from a combustion gas generated through a combustion reaction and heat the water;

a heating heat exchanger configured to receive the water heated by the water heater and exchange heat with air that is to be discharged for heating;

a fan configured to send the air to the heating heat exchanger; and a case, in which the water heater, the expansion tank, the heating heat exchanger, and the fan are disposed in an interior thereof;

wherein the case includes:

an outer box having a first opening in a reference direction that is one direction that is perpendicular to an upward/downward direction;

a first opening cover coupled to the outer box and covering the first opening when being coupled to the outer box;

a first partition wall coupled to the outer box, and extending along the reference direction to divide an interior of the outer box to a first division space and a second division space;

a second partition wall disposed in the interior of the outer box to be perpendicular to the first partition wall to divide the first division space to a (1-1)-th division space and a (1-2)-th division space; and a third partition wall disposed in the interior of the outer box to be perpendicular to the first partition wall to divide the second division space to a (2-1)-th division space and a (2-2)-th division space; and wherein the second partition wall and the third partition wall may be separated from the interior of the outer box;

wherein the water heater is disposed in the (1-1)-th division space;

wherein any one of the heating heat exchanger or the fan is disposed in the (1-2)-th division space;

wherein the expansion tank is disposed in the (2-1)-th division space; and wherein the other one of the heating heat exchanger or the fan is disposed in the (2-2)-th division space.

* * * * *